US007918553B2

(12) United States Patent
Kagami et al.

(10) Patent No.: US 7,918,553 B2
(45) **Date of Patent: *Apr. 5, 2011**

(54) RECORDING APPARATUS

(75) Inventors: Yuji Kagami, Kanagawa-Ken (JP); Koichiro Kawaguchi, Kanagawa-Ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/502,624

(22) Filed: Jul. 14, 2009

(65) Prior Publication Data

US 2009/0273138 A1 Nov. 5, 2009

Related U.S. Application Data

(62) Division of application No. 12/118,084, filed on May 9, 2008, now Pat. No. 7,578,590, which is a division of application No. 11/288,139, filed on Nov. 29, 2005, now Pat. No. 7,387,382, which is a division of application No. 10/601,524, filed on Jun. 24, 2003, now Pat. No. 6,991,331.

(30) Foreign Application Priority Data

Jun. 25, 2002 (JP) ..... 2002-184484
Jul. 8, 2002 (JP) ..... 2002-198709

(51) Int. Cl.
*B41J 29/13* (2006.01)

(52) U.S. Cl. ..... 347/108; 347/104

(58) Field of Classification Search ..... 347/16, 347/101, 104–105, 108
See application file for complete search history.

(56) References Cited

U.S. PATENT DOCUMENTS

| | | | | |
|---|---|---|---|---|
| 5,033,731 | A | 7/1991 | Looney | 271/176 |
| 5,807,003 | A | 9/1998 | Kobayashi et al. | 400/625 |
| 5,927,877 | A | 7/1999 | Kelly et al. | 400/625 |
| 5,931,464 | A * | 8/1999 | Shimizu et al. | 271/296 |
| 5,982,400 | A | 11/1999 | Yokoi et al. | 346/134 |
| 6,092,893 | A | 7/2000 | Yokoi et al. | 347/104 |
| 6,095,516 | A | 8/2000 | Sawano et al. | 271/207 |
| 6,170,817 | B1 | 1/2001 | Kawaguchi | 271/167 |
| 6,296,407 | B1 | 10/2001 | McKay et al. | 400/624 |
| 6,318,855 | B1 | 11/2001 | Kawaguchi | 347/104 |
| 6,659,454 | B1 | 12/2003 | Smith et al. | 271/213 |
| 2002/0114655 | A1 | 8/2002 | Kwaguchi et al. | 400/578 |
| 2003/0030712 | A1 | 2/2003 | Kawaguchi et al. | 347/104 |

* cited by examiner

*Primary Examiner* — Thinh H Nguyen
(74) *Attorney, Agent, or Firm* — Fitzpatrick, Cella, Harper & Scinto

(57) ABSTRACT

This invention relates to a recording apparatus, comprising an opening delivering a recording medium after completion of recording and a cover capable of closing the opening in moving pivotally and a holding rib formed at the cover for holding a rear end as well as both sides of the delivered recording medium. The holding rib comes to be exposed when the cover is opened.

5 Claims, 31 Drawing Sheets

RECORDING APPARATUS

This application is a divisional of U.S. patent application Ser. No. 12/118,084, filed May 9, 2008, now U.S. Pat. No. 7,578,590, issued Aug. 25, 2009, which is a divisional of U.S. patent application Ser. No. 11/288,139, filed Nov. 29, 2005, now U.S. Pat. No. 7,387,382, issued Jun. 17, 2008, which is a divisional of U.S. patent application Ser. No. 10/601,524, filed Jun. 24, 2003, now U.S. Pat. No. 6,991,331, issued Jan. 31, 2006.

BACKGROUND OF THE INVENTION

1. Field of the Invention

This invention relates to a recording apparatus such as a photocopier, word processor, personal computer, facsimile machine and, more particularly, to a recording apparatus responsible to various recording media.

2. Description of Related Art

A conventional recording apparatus of this type is typically structured as shown in FIG. 29. That is, a body forming an outer housing of the recording apparatus is constituted of a lower casing 120, an upper casing 121, an access cover 122, a delivery tray unit, and a printer unit 130 contained in the outer housing members.

The delivery tray unit (in some cases, hereinafter referred to as "delivery tray") is constituted of two members: a rotary tray 126 and a base tray 127, and a rotary shaft 126*a* and a bearing 127*a* are formed at each end and fitted to each other to hold the rotary tray 126 to the base tray rotatably. Meanwhile, an attachment 127*b* is formed at the other end of the base tray 127 and is engaged with an engagement portion 120*a* formed at the lower casing 120. With these structures, recording media 133 (hereinafter, referred to as "sheets") delivered from the printer unit 130 are stacked, as shown in FIG. 31, on a sheet stacking surface formed on a delivery tray unit.

The rate of the sheets delivered from the printer unit 130 (hereinafter referred to as "delivery rate" in some cases) is very fast to increase the printing rate, so that the sheets may drop off forwardly from the sheet stacking surface. Moreover, because the printing rate is fast, a subsequent sheet may be stacked where ink on the previously recorded sheet is not dried yet. Therefore, recording defects may occur frequently such that the sheets may be messed with the ink and that the recordings on the previous sheet may be worn out.

To solve those problems, the rotary tray 126 and the base tray 127 are made in special forms. That is, the apex of the rotary tray is in an arc shape whereas a part of the base tray is in an arc shape, and thereby, the delivered sheets are held as curving. Where the sheets are held as curving, not only messing with ink due to delivery of the subsequent sheets but also dropping of the sheets from the delivery tray caused by high rate delivery operation, is prevented. It is ordinary, when the recording apparatus is not used, that the rotary tray 126 is moved pivotally to come in contact with the housing front and to be held substantially upright or that the base tray 127 is removed from the lower casing 120 to preserve the delivery tray unit at other locations.

With the conventional art, however, it is ordinary, when the recording apparatus is not used, that the rotary tray 126 is moved pivotally to come in contact with the apparatus body front and to be held substantially upright or that the rotary tray 126 is removed from the lower casing 120 to be preserved at other locations. Thus, there raise the following problems.

The designed appearance is not favorable because a resort that the rotary tray 126 is held substantially upright is taken while the apparatus is not used. Particularly, since the front end shape of the rotary tray 126 is in the large arc shape to solve the above recording defects, it is hard to produce unity feeling between the apparatus body and the rotary tray 126 in an aspect of the appearance.

In a meantime, where the delivery tray unit is contained in the housing, because the front end is in the arc shape, the apparatus height is increased, and such a unit therefore obstructs designing toward a compacter apparatus size.

The appearance is not favorable since the internal structure including the printer unit can be seen largely where the housing front opening is structured to widely open if the delivery tray unit is removed from the apparatus body while the recording apparatus is not in use. Foreign objects such as dust may enter from the opening, so that such a circumstance is not favorable for the printer unit. Where the delivery tray unit is detached from the delivery tray unit, the operator may lose the delivery tray unit inadvertently.

SUMMARY OF THE INVENTION

It is an object of the invention to provide a recording apparatus having a delivery tray unit in preventing recording defects with excellence in industrial design as well as controllability without rendering inferior the appearance of the recording apparatus.

A representative structure according to the invention to accomplish the above object is a recording apparatus including: an opening delivering a recording medium after completion of recording; a cover capable of closing the opening in moving pivotally; and a holding rib formed at the cover for holding a rear end as well as both sides of the delivered recording medium, wherein the holding rib comes to be exposed when the cover is opened.

Another representative structure according to the invention to accomplish the above object is a recording apparatus including: a frame constituting an apparatus housing having an opening for delivering a recording medium after completion of recording; a cover formed to the frame as pivotally movable and capable of closing the opening in making a part of the apparatus housing; a delivery tray for stacking and holding the recording medium delivered from the opening; a tray container formed at a bottom of the frame for retractably containing the delivery tray; and a rail member formed adjacently to the tray container for guiding retractably the delivery tray to the tray container and holding the opened cover at a prescribed position, wherein the delivery tray pulled out of the tray container is held at a rear surface of the cover held at the prescribed position.

This invention thus structured can provide a compact high performance recording apparatus with excellence in industrial design and controllability in preventing recording defects from occurring as well as solving the problems in prior art.

DETAILED DESCRIPTION OF THE PREFERRED EMBODIMENTS

Figure 1:
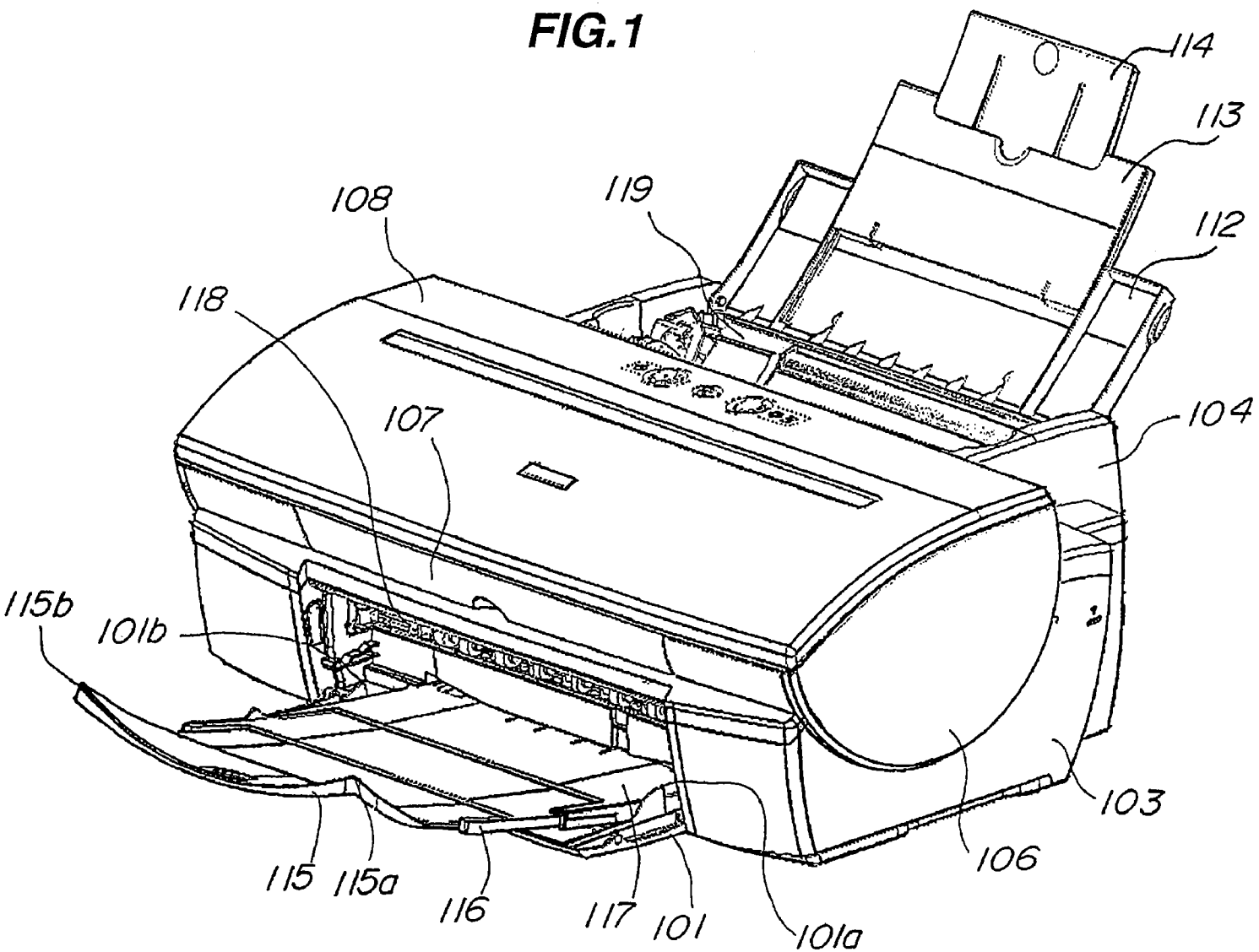
FIG. 1 is a perspective view showing a recording apparatus.

Hereinafter, referring to the drawings, preferred embodiments of the invention are described in detail in an exemplifying manner. The size, material, shape, correlative layout of structural parts as set forth in the embodiments below can be modified property according to the structure of the apparatus to which this invention applies and various conditions, and the scope of the invention is not intended to be limited to those as far as any specific described does not exist.

First Embodiment

Figure 2:
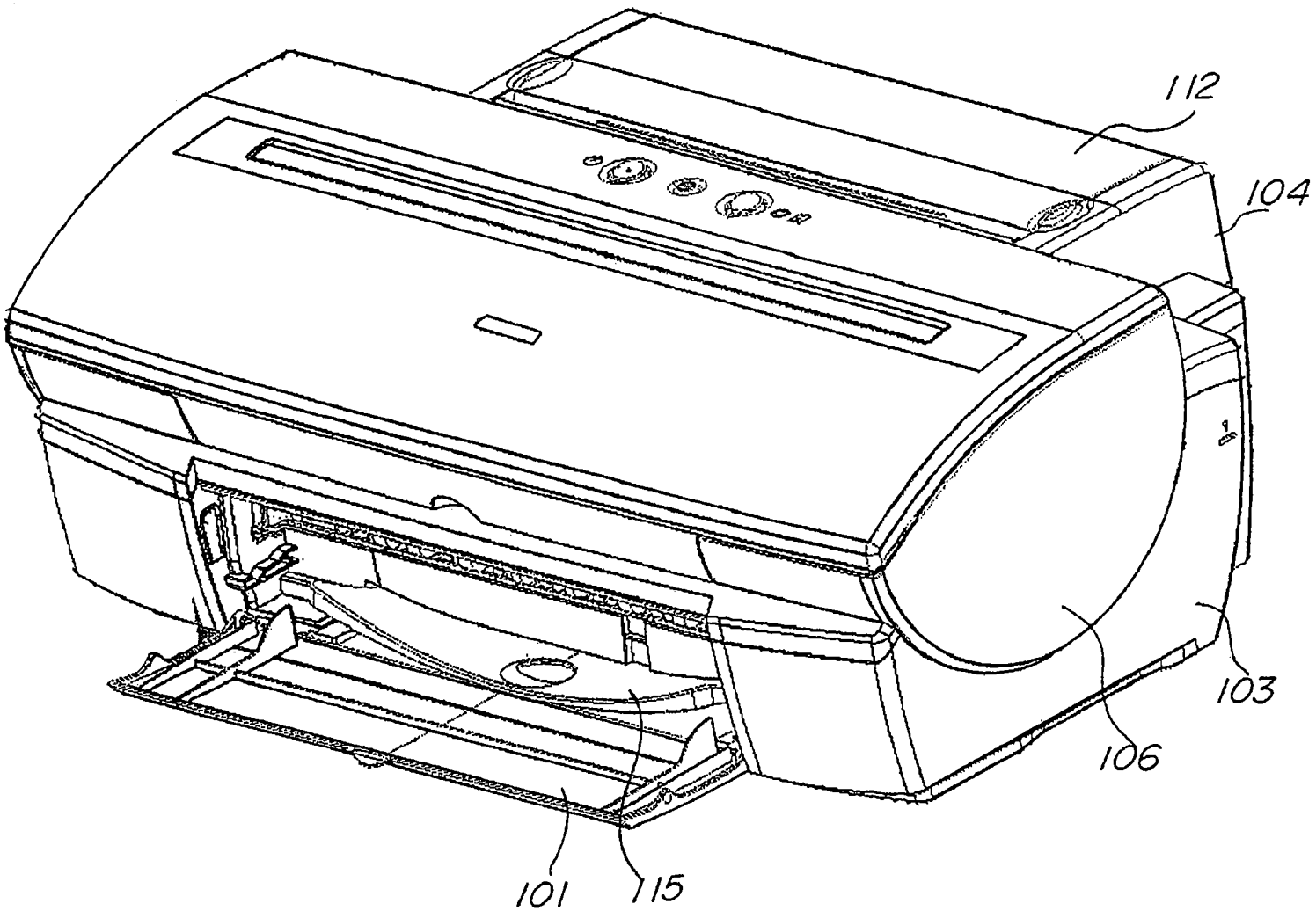
FIG. 2 is a perspective view showing the recording apparatus where a front cover is opened.
Figure 3:
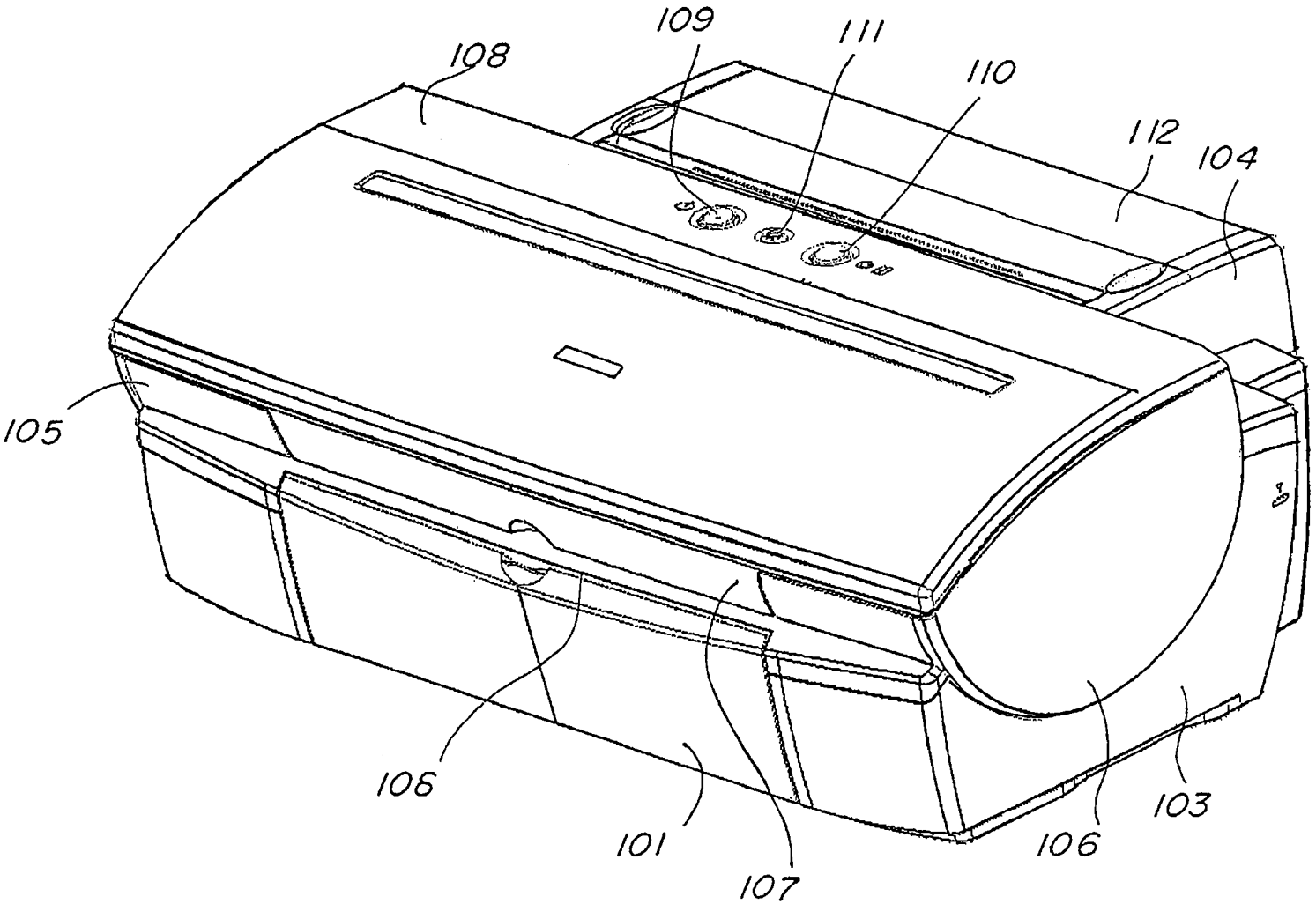
FIG. 3 is a perspective view showing the recording apparatus where a front cover is closed.

FIG. 1 is a perspective view showing a recording apparatus body (hereinafter referred to as "body" in some cases) mounting a tray according to the first embodiment of the invention and showing a situation that the front cover is opened to pull out the delivery tray unit contained in a bottom of the body; FIG. 2 is a perspective view showing the recording apparatus where the front cover is opened; FIG. 3 is a perspective view showing the recording apparatus where the front cover is closed;

The body forming a housing of the recording apparatus in this embodiment is constituted of a lower casing 103, an upper casing 104, an access cover unit (hereinafter referred to as "access cover") structured by incorporating a cover 108 into an access cover base 107, a delivery tray unit (hereinafter referred to as "delivery tray") made of a first delivery tray 115, a second delivery tray 116, and a third delivery tray 117, housing members made of a front cover 101 rotatably held and secured to the lower casing 103, a side cover 106 held and attached detachably to the lower casing 103 and the upper casing 104 serving particularly as a design element part (i.e., the product image can be changed upon changing the color of the side cover 106), and an ASF cover 112 covering an automatic sheet feeder 119 (hereinafter referred to as "ASF" in some cases), and a printer unit 118 contained in the housing members.

The lower casing 103 forms approximately a lower half of the apparatus body, and the upper casing forms an upper half of the apparatus body. A hollow structure having a containing space inside for containing the printer unit 118 is formed by combination of both casings, and an opening is formed at a top surface and a front portion of the apparatus body, respectively.

The printer unit 118 has a conveying means for conveying the sheet, and a recording means for discharging the ink in the ink tank through the recording head, and scans the recording means with respect to the conveyed sheet in a direction perpendicular to the conveyance direction of the sheet to make recording. The recording head as a recording means is for recording an ink image on the recording sheet. As a recording means for this apparatus, an inkjet recording method is used in which ink is discharged from the recording head. That is, the recording head includes fine fluid outlets (orifices), fluid routes, energy operation portions formed at a portion of the fluid routes, and energy generating means for generating droplet formation energy operating the fluid located at the energy operation portion.

As an energy generating means for generating such energy, employed are a recording method using an electromechanical converter such as a piezo device or the like, a recording method using an energy generating means generating heat upon radiation of electromagnetic wave of laser or the like, and a recording method using an energy generating means discharging fluid in heating the fluid with an electro-thermal converter such as a heat generating device having a heating resister.

The recording head used for inkjet recording method discharging the fluid with thermal energy, inter alia, can make recording with high definition because the fluid outlet (orifices) for forming droplets to be discharged by discharging droplets for recording can be arranged in a high density. The recording head using the electro-thermal converter as the energy generating means, inter alia, is easily made compact and is advantageous because the head can be mounted with a high density and be produced with less costs.

In this embodiment, as a discharge structure for ink, it is structured to make recording by energizing the electro-thermal converter in response to a recording signal and by discharging ink through the orifices upon growth and contraction of bubbles generated in the ink in utilizing the film boiling generated in the ink from the thermal energy.

The front cover 101 is structured so that one end is rotatably and movably held to the lower casing 103 and so that the opening formed at a front portion of the lower casing 103 can be opened and closed according to the rotary motion. A delivery tray unit is held so as to be capable of sliding at a lower portion of the printer unit 118, or namely at a bottom of the lower casing 103. The sheets therefore can be delivered from the delivery tray unit upon rotating the front cover 101 when executing the recording operation to open the opening and upon pulling out the delivery tray unit from the apparatus body, and the delivered respective sheets are subsequently stacked on the delivery tray (see, FIG. 4).

The delivery tray unit is structured as incorporated in a manner that respective three trays (the first delivery tray 115, the second delivery tray 116, and the third delivery tray 117) can slide, and the respective trays are pulled out forward when necessary, the sheet supporting area can be enlarged or reduced in three ways. The front end of the first tray is in an arc shape to maintain the delivery performance.

The access cover base 107 is structured that an end is held rotatably to the upper casing 104 to open and close the opening formed at the top surface of the apparatus body. The cartridge, not shown, of the recording head, the ink tank, not shown, which are contained in the interior of the apparatus body, become replaceable upon opening the access cover base 107. The access cover 108 is made of an aluminum thin plate material, and around the cover, attachment legs, not shown, are formed. The access cover 108 is held to the access cover base 107 upon inserting the attachment legs and folding the attachment legs. It is not illustrated herein specifically, but when the access cover is made open and closed, the projection formed on the back surface of the cover moves the cover opening closing lever rotatably, and when the lever pushes the micro switch, opening and closing states of the access cover can be detected.

The first feeding tray 113 and the second feeding tray 114 are contained as slidable at the back surface of the ASF cover 112. Where the operator makes printing, the sheet to be printed can be held at a prescribed position of the automatic sheet feeder by pulling out the respective feeding trays.

On a top surface of the rear portion of the apparatus body of the upper casing 104, as shown in FIG. 3, a power key 109 and a resuming key 110 are formed so as to be pushed down, and also an LED 111 is formed and informs a recordable status upon turning on the LED 111 to the operator while the power key 109 is pushed down. More specifically, the power key 109 and the resuming key 110 are formed in a united body, and a cap molded of a stainless thin plate in a squeezed manner at a protrusion top of the base material is attached to each key. The LED 111 has various displaying functions to inform the operator of the operation statuses or troubles of the recording apparatus by changing the way of blinking and color and beeping with a beeper, not shown. It is to be noted that when the trouble or the like is solved, recording can be resumed upon pushing the resuming key 110. In a case such that the recording apparatus is not used, the front cover 101 is moved pivotally to contact with the upper casing 104, thereby producing a space δ for delivering, out of apparatus body, sheets delivered from the printer unit 118.

Figure 5:
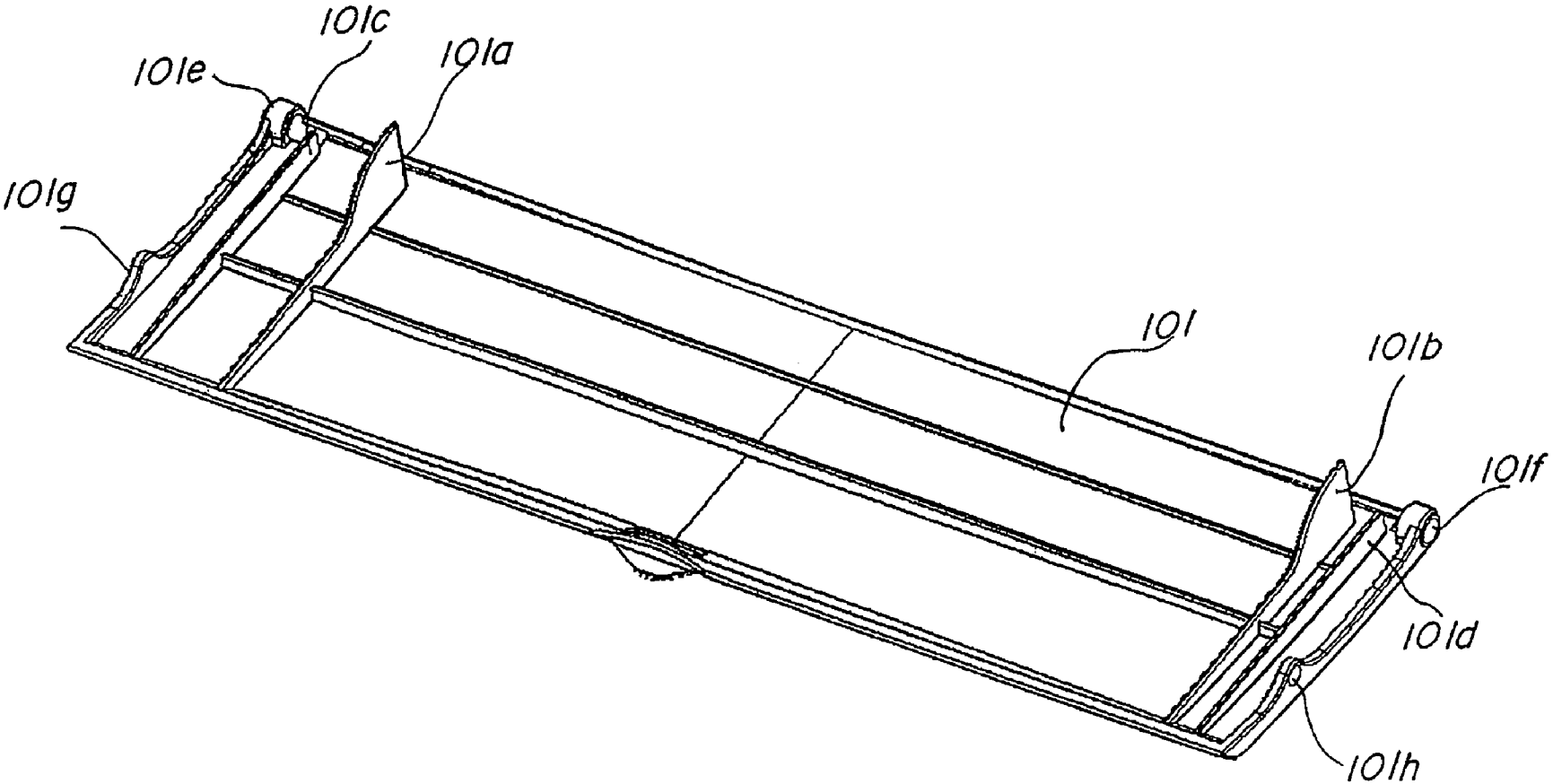
FIG. 5 is a perspective view showing a front cover in the first embodiment.

FIG. 5 is a perspective view of the front cover 101 to which this invention applies. On a side surface, rotary shafts 101*e*, 101*f* for fitting to the lower casing 103 in a pivotal manner are formed, and recesses 101*g*, 101*h* are formed for engaging with clicking portions, not shown, of the lower casing 103 when the front cover 101 is closed. On a rear side, guide ribs 101*c*, 101*d* used for attaching a CD-R unit, not shown, an apparatus for mounting to the CD-R unit a CD attached to a CD-R tray and inserting the CD-R into the printer unit for making recording on a top side of the CD, to the recording apparatus upon opening the front cover 101, and recording medium holding ribs 101*a*, 101*b* of this embodiment are respectively formed in a united body.

Figure 6:
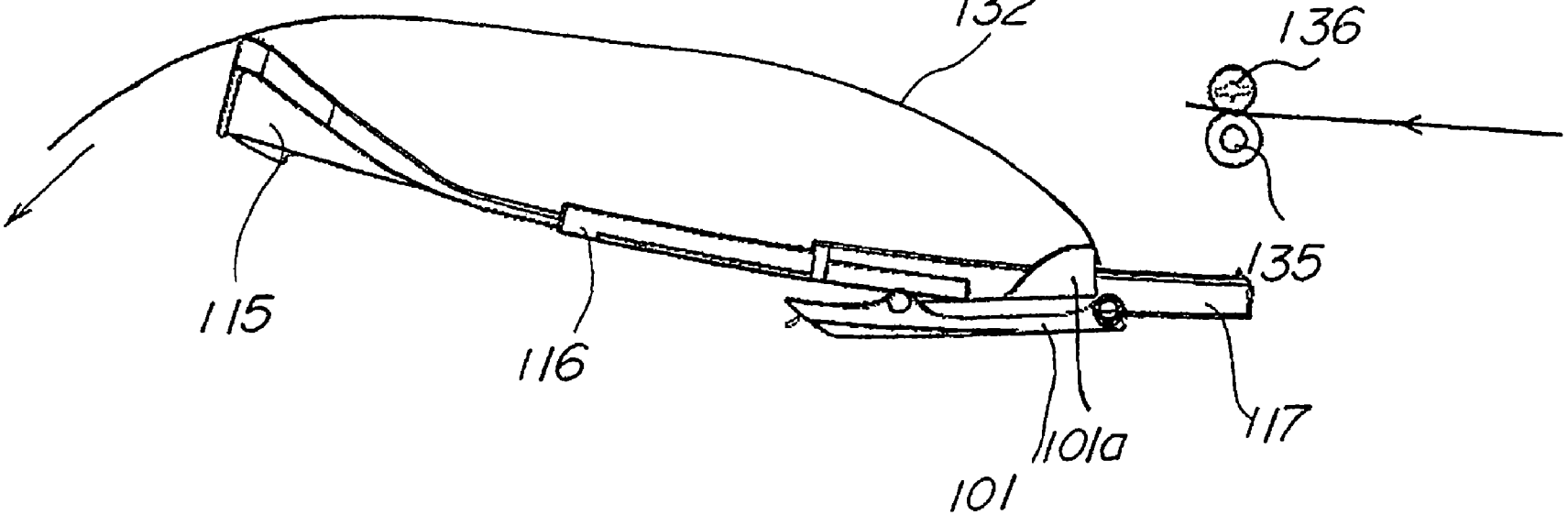
FIG. 6 is a side view showing the front cover in the first embodiment and illustrating an effect of a recording medium holding rib.

FIG. 6 is a schematic illustration showing an effect on the recording medium holding ribs as an engaging means or a protrusion member of the embodiment, and is an illustration showing a situation that the first delivery tray 115, the second delivery tray 116, and the third delivery tray 117 are pulled out. In the recording apparatus of the invention, the whole length of the delivery tray is structured short so as to contain the delivery tray below the lower casing 103. A delivery roller 135 and a spur 136 shown in FIG. 6 constitute a delivery outlet in the opening of the printer unit 118. The spur means a rotary body having a small contact area to the sheet 132 and not messing any ink image even where contacting to a sheet surface side on which ink images are recorded with ink discharge.

Figure 7:
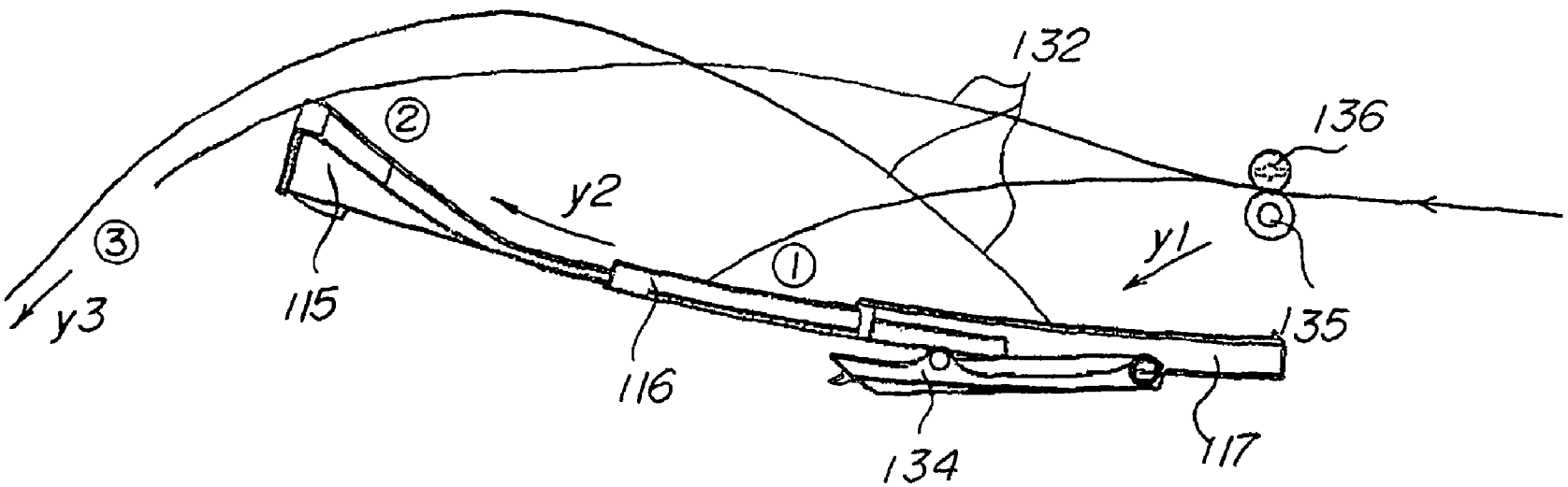
FIG. 7 is a schematic side view illustrating a sheet's trace where no recording medium holding rib is formed on the front cover.

FIG. 7 is a schematic side view showing a sheet trace where no recording medium rib is formed on the front cover. With this structure, the sheet 132 may be curled in an upward orienting convex way as shown in FIG. 7 by printing environment (particularly, low temperature and low humidity) as well as recording patterns where recording is made on a rigid sheet such as a special sheet for high quality printing, and if delivered with a high speed, the sheet may go beyond the delivery tray and frequently are stacked in a not neat shape.

More specifically, the recorded sheet 132 is delivered sequentially in an arrow shape by nipping rotary motion of the delivery roller 135 and the spur 136. The front end of the sheet 132, as recording is completed, touches the top surface of the delivery tray (state of (1)), and when the delivery proceeds, the front end of the sheet 132 proceeds in a direction of y2 gradually in sliding on the top surface of the delivery tray. The front end of the sheet 132 comes out of the first delivery tray 115 at a position that the sheet approximately finishes a state nipped by the delivery roller 135 and the spur 136, and the sheet 132 suspends downward with curling of the sheet 132 (state of (2)). Because the rotational speed of the delivery roller 135 and the spur 136 are increased suddenly when the sheet 132 is completely delivered, the rear end of the sheet 132 drops off in a direction of y1 (state of (3)), and the front end is suspended more downward, but the sheet falls off from the first delivery tray 115 resultantly from momentum as the delivery rate is fast.

By formation of the recording medium holding ribs 101*a*, 101*b* shown in FIGS. 5, 6 on the front cover 101, the sheet is prevented from being delivered forward more than needed upon that the curled sheet rear end hits the apexes of the recording medium holding ribs 101*a*, 101*b*. Particularly, with respect to the plain paper, it is advantageous because the sheet is not rigid and curling of the sheet is corrected during recording even where the sheet is curled.

Figure 4:
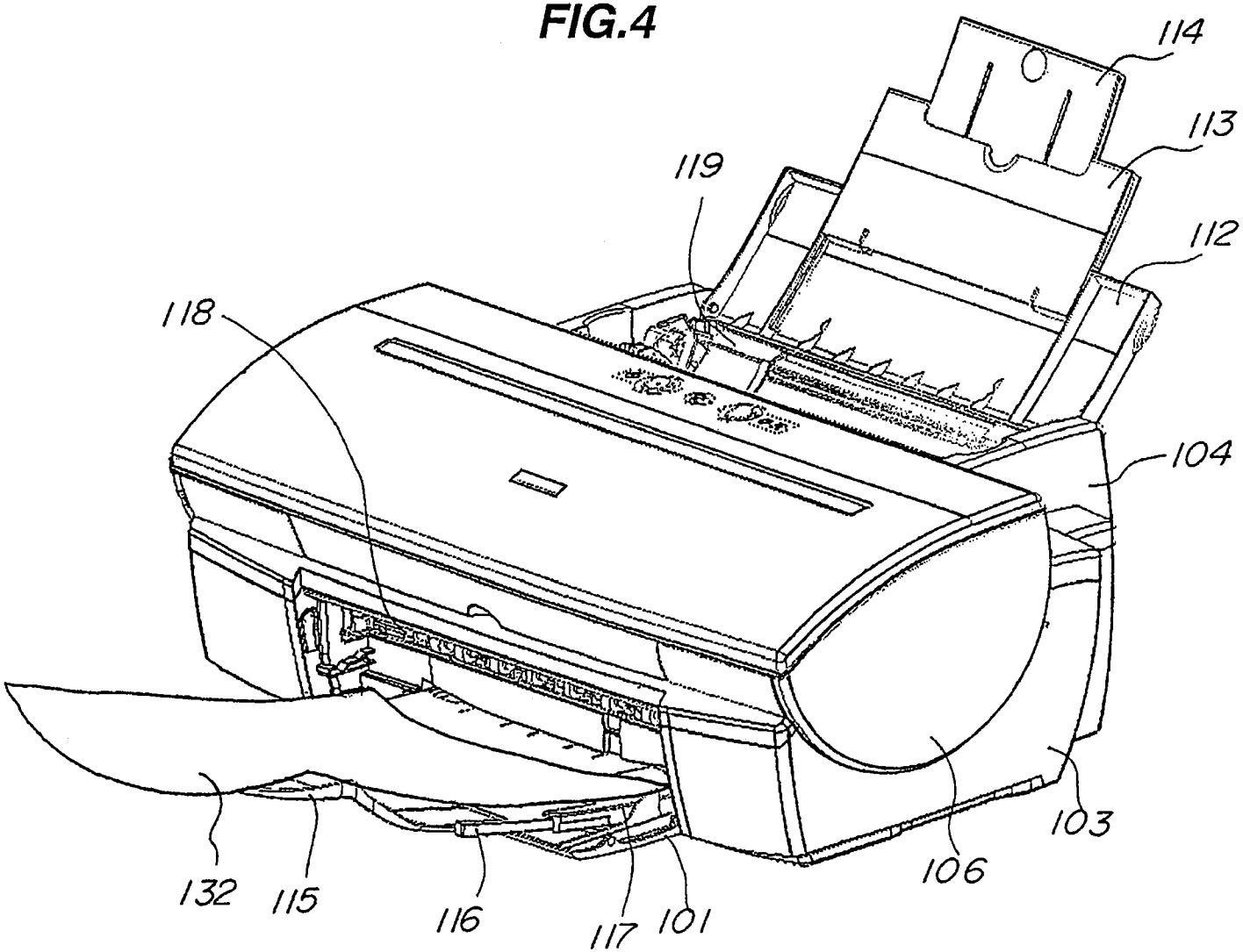
FIG. 4 is a perspective view showing the recording apparatus where the front cover is opened.

As shown in FIG. 4, the front end of the first delivery tray 115 is in an arc shape, and the plain paper or the like of less rigidity is stacked on the delivery tray with curving by the recording medium holding ribs 101*a*, 101*b* of the front cover 101. As described above, the sheets are stacked on the delivery tray with having a curvature, so that the sheets are prevented from subjecting to recording defects such as messing with ink caused by the sheets sequentially delivered, and so that the sheets with a high delivery speed can be prevented from falling off from the delivery tray.

In this embodiment, because of thus structured, recording defects can be prevented with the front cover structured in a united body with the recording apparatus. Because the recording medium holding ribs 101*a*, 101*b* are formed on the front cover 101 covering the printer unit 118, the printer unit 118 cannot be seen from the exterior when the front cover 101 is closed, and the recording medium holding ribs 101*a*, 101*b* also cannot be seen from the exterior. The delivery tray unit cannot be detached easily from the apparatus body, so that the operator may not lose the delivery tray unit inadvertently.

Second Embodiment

Figure 8:
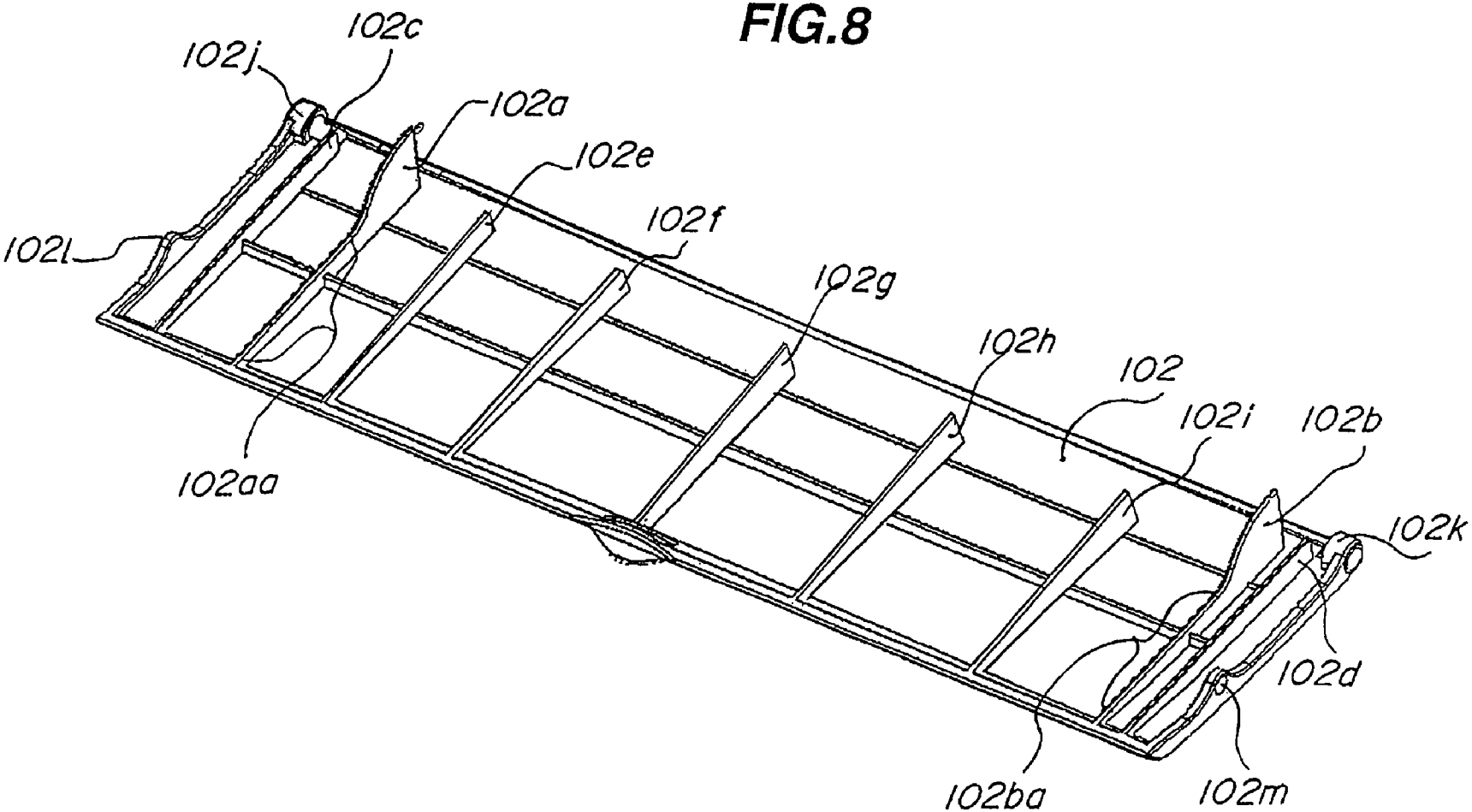
FIG. 8 is a perspective view in the second embodiment.

The second embodiment is described in reference to the drawings. A description of structures substantially the same as described above is omitted. FIG. 8 is a perspective view showing a front cover in the second embodiment; in FIG. 8, numerals 102*e* to 102*i* are the recording medium passing ribs 102. In this embodiment, parts 102*aa*, 102*ba* on the top surface of the recording medium holding ribs 102 are in the same shape as the top surface of the recording medium passing ribs.

Figure 9:
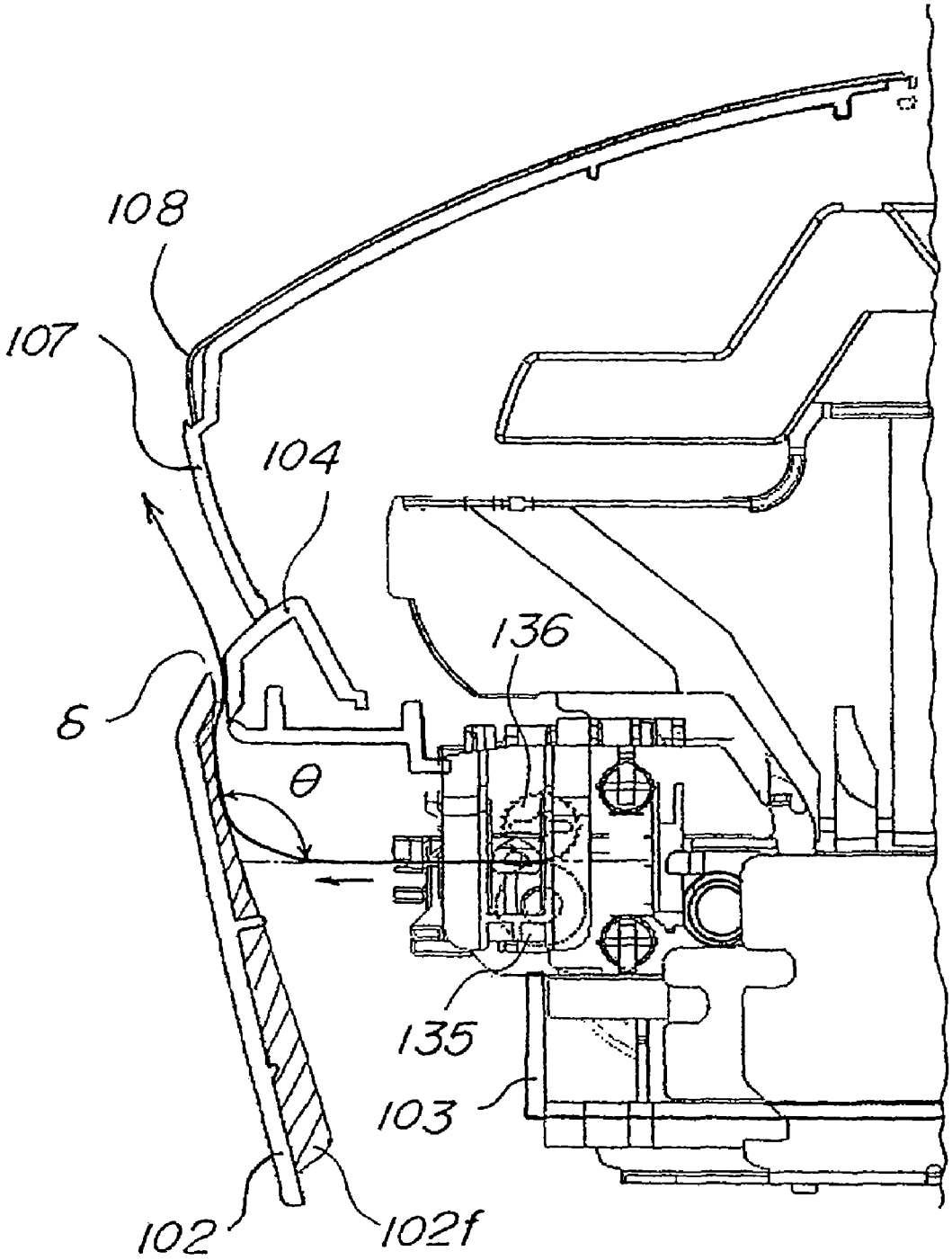
FIG. 9 is a schematic cross section showing an apparatus body when attaching the front cover in the second embodiment.

FIG. 9 is a schematic diagram showing a recording apparatus when the front cover 102, in the second embodiment, is attached to the apparatus body. In FIG. 9, as examples of the recording medium passing ribs 102*aa*, 102*ba*, and 102*e* to 102*i*, the recording medium passing rib 102*f* is used for explanation. When the front cover 102 is closed as shown in FIG. 9, the front cover 102 comes in contact with the upper casing 104, but is formed with the space δ extending in a full width of a recordable sheet. An angle θ between the sheet conveyance rote and the recording medium passing rib 102*f* is set to be an obtuse angle having 90 degrees or more.

According to the above structure, the front end of the sheet slides on the top surface of the recording medium passing rib 102*f* even where the operator instructs the beginning of recording operation to operate the recording apparatus for recording operation and to execute the sheet feeding, and the sheet is guided with the space δ allowing the sheet to be delivered out of the recording apparatus. That is, even where the operator starts recording without inadvertently moving pivotally the front cover 102, the recording apparatus can prevent the sheet from stacking in the recording apparatus (in other words, avoiding paper jamming).

Thus, in the recording apparatus having a delivery tray of a rotary type closing the opening, where the space δ is formed, and where the angle between the conveyance route of the sheet and the sheet stacking surface is set at 90 degrees or more, paper jamming can be avoided.

Third Embodiment

Figure 10:
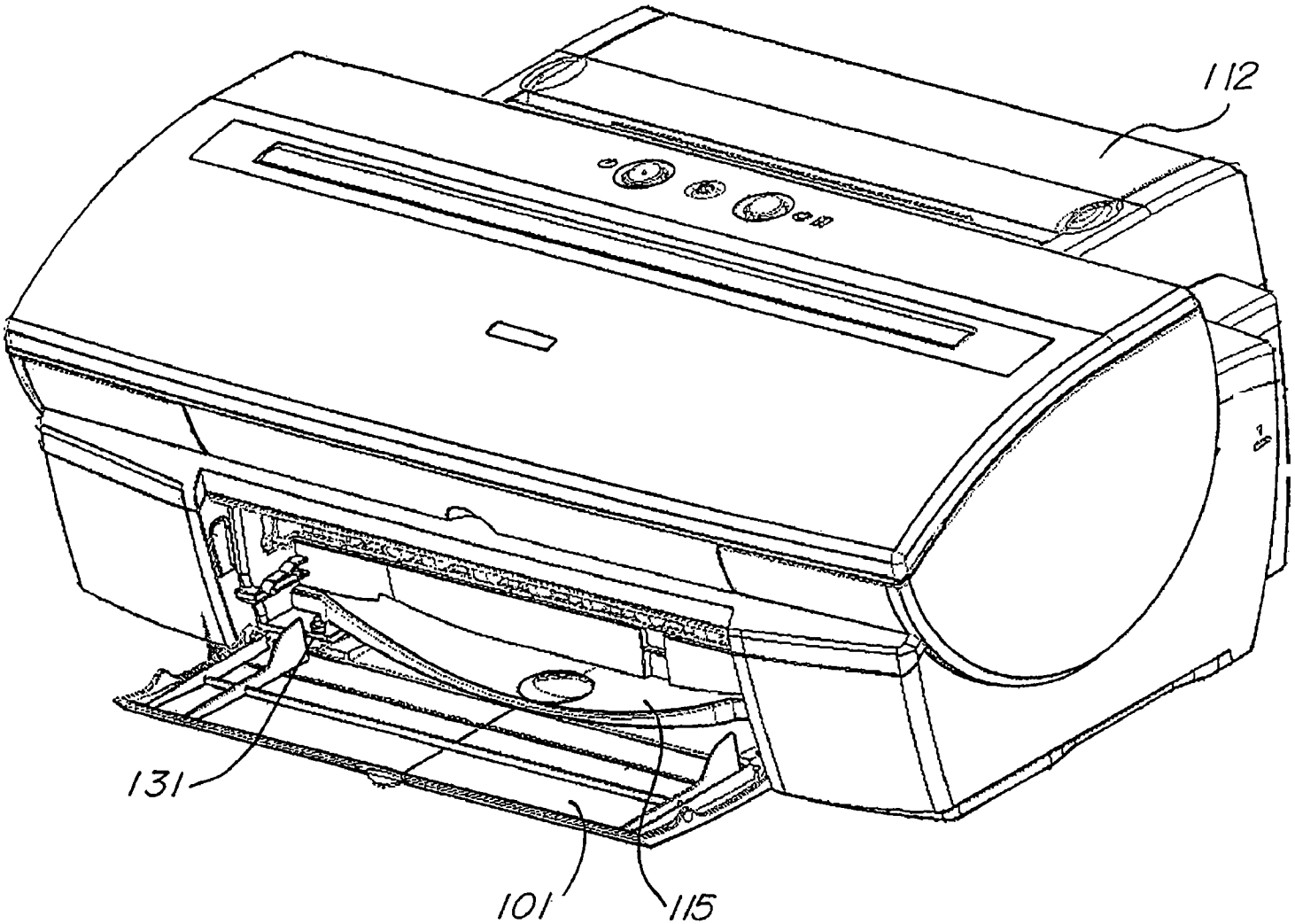
FIG. 10 is a perspective view showing a recording apparatus in the third embodiment.

The third embodiment is described in reference to the drawings. A description of structures substantially the same as described above is omitted. FIG. 10 is a perspective view showing a recording apparatus in the third embodiment. A sensor switch 131 shown in FIG. 10 is of a mechanical type, and the recording operation can be turned on and off by moving a head portion 131*a* up and down.

Figure 11:
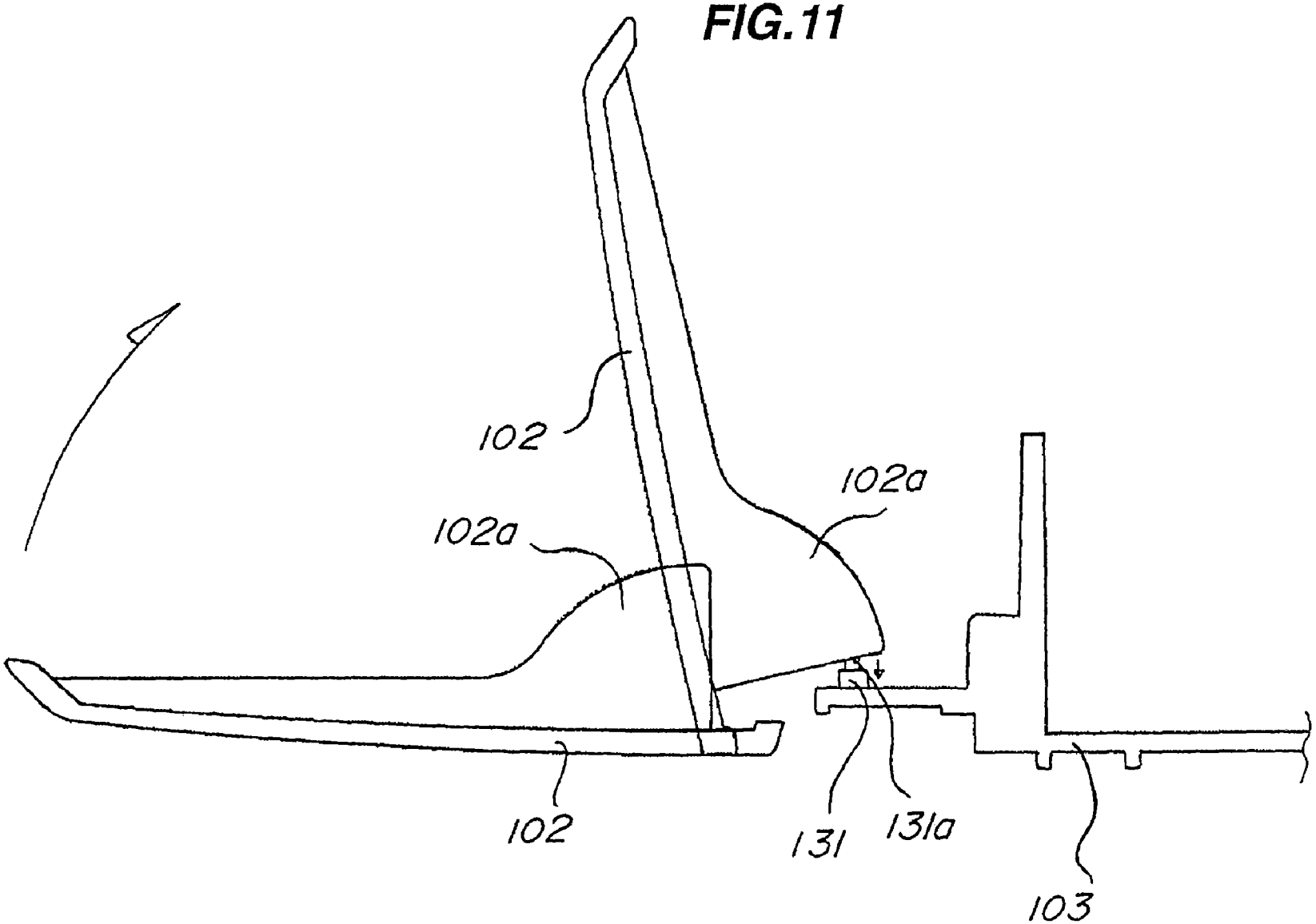
FIG. 11 is a schematic view showing a sensor switch pushing down means.

The sensor switch 131 is attached to a location where not disturbing pulling and containing actions of the delivery tray, and sheet stacking action, or the like at the lower casing. FIG. 11 is a schematic diagram showing pushing down means of the sensor switch 131. As shown in FIG. 11, it is structured that, when the front cover 102 is closed (pivotally moved in an arrow direction in FIG. 11), the rear end of the recording medium holding rib 102 a formed on the front cover 102 pushes down the head 131*a* of the sensor switch 131, and when the front cover 102 is opened, the rear end of the recording medium holding rib 102*a* is separated from the head 131*a* of the sensor switch 131. That is, the sensor switch is turned on and off in association with the pivotal movement of the front cover 102.

With this structure described above, for example, because the rear end of the recording medium holding rib 102*a* pushes down the head of the sensor switch 131 where the front cover 102 is closed, the sensor switch 131 is turned on, and the apparatus detects that the front cover 102 is closed. At that time, the carriage locking is made on a side of the recording apparatus. With such a setting, the recording operation is not done even where the operator inadvertently executes beginning of recording operation as the front cover 102 is closed.

Fourth Embodiment

Although in the above embodiment, the sensor switch of a mechanical type is used as a means for detecting the opening and closing state of the front cover, but this invention is not limited to this, and for example, substantially the same advantages can be obtained in use of an optical type as a sensor switch. Although the means for locking the carriage is used on the recording apparatus side when the operator executes the beginning of the recording operation, the recording apparatus may generate a beeping sound when the operator manipulates the apparatus inadvertently and display a warning on the screen on a personal computer, thereby informing the operator of the closing state of the front cover.

Fifth Embodiment

Next, other structures of the recording apparatus according to the invention are described.

Figure 12:
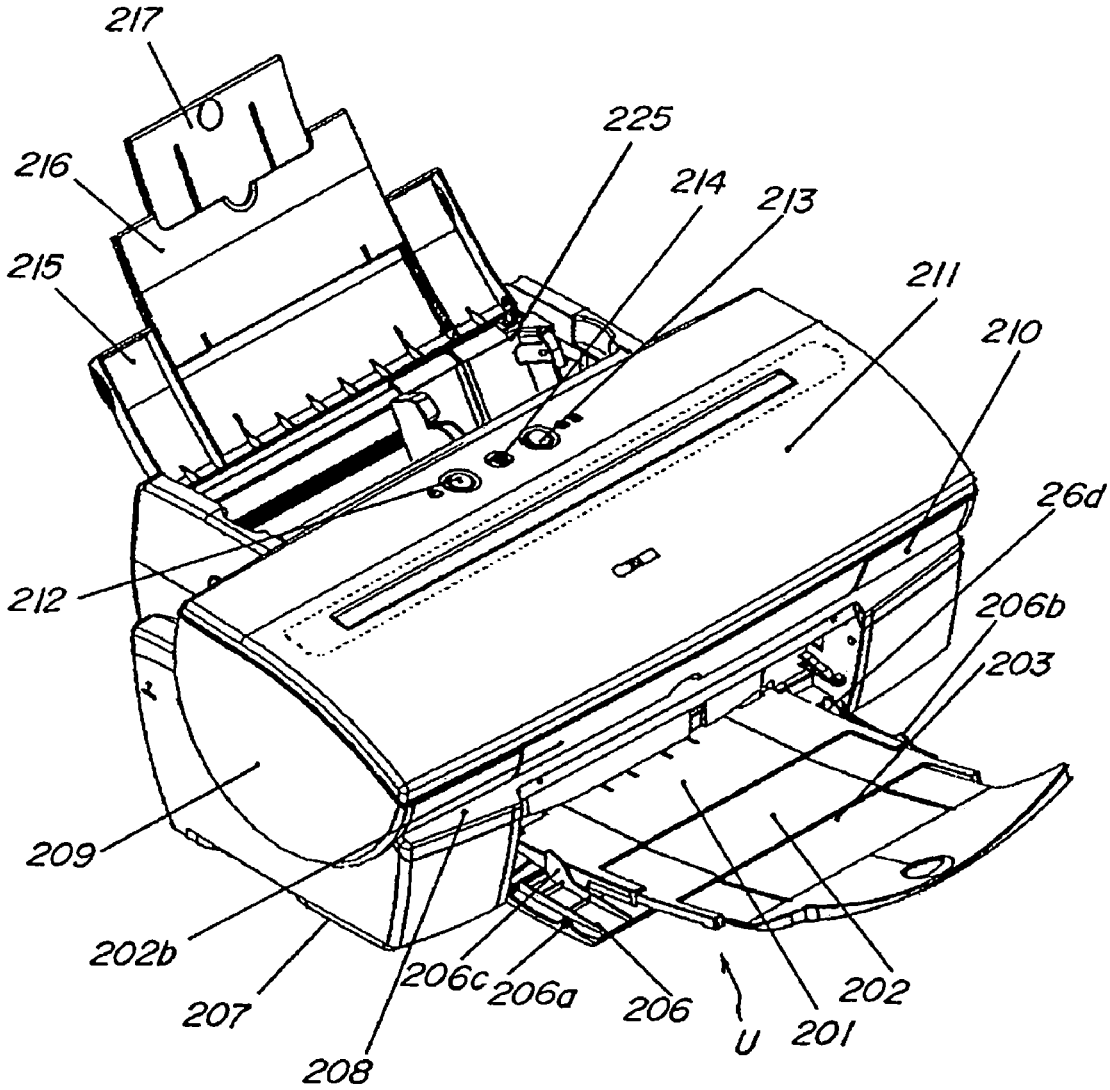
FIG. 12 is a perspective view showing a recording apparatus using this invention.
Figure 13:
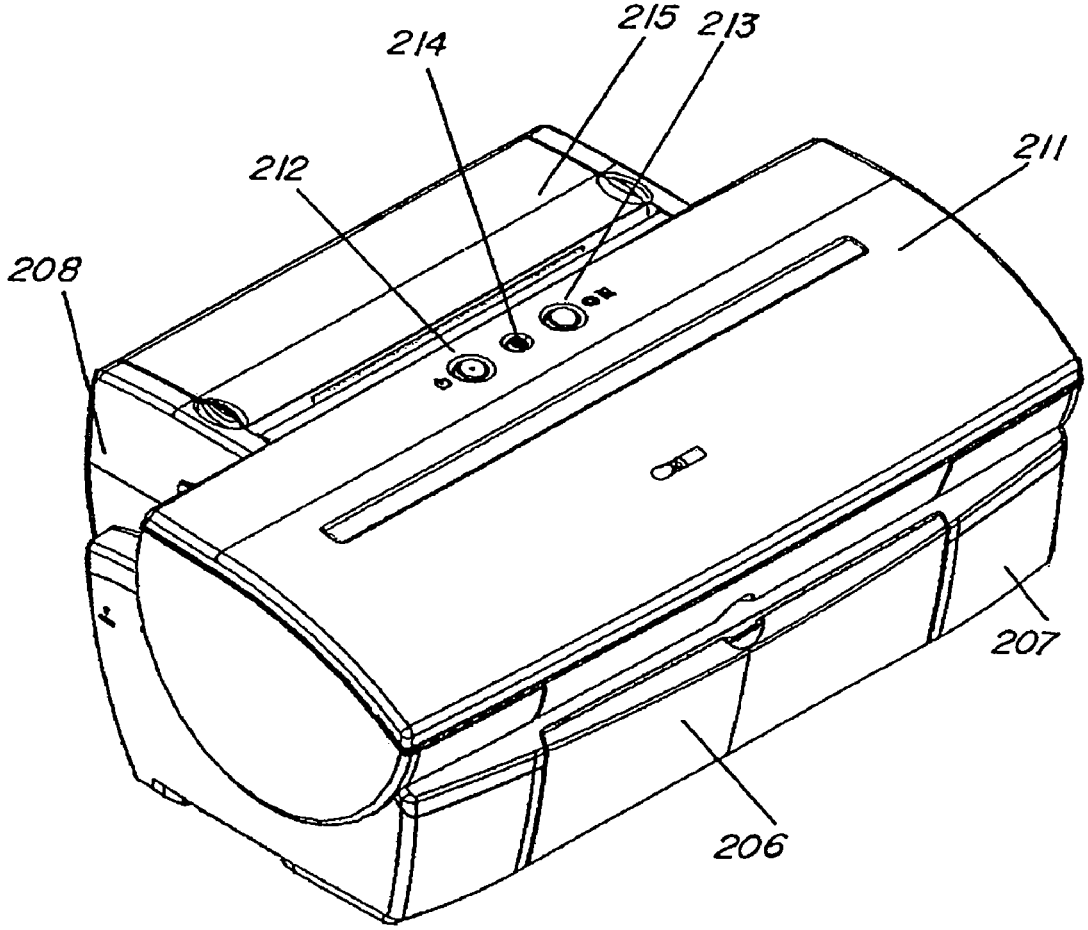
FIG. 13 is a perspective view showing the recording apparatus according to the first embodiment when the cover is closed.

FIG. 12 and FIG. 13 are perspective views showing a recording apparatus according to this embodiment. The recording apparatus shown in FIG. 12, FIG. 13 is made of a first delivery tray 201, a second delivery tray 202, a third delivery tray 203, a front cover 206, a lower casing 207, an upper casing 208, an L-side cover 209, a R-side cover 210, an access cover 211, a power key 212, a resume key 213, an LED 214, a feeding cover 215 covering the automatic feeding apparatus, a first feeding tray 216, a second feeding tray 217, and an automatic sheet feeder 225 (hereinafter referred to as "ASF" in some cases).

The recording apparatus in this embodiment is structured of the lower casing 207 and the upper casing 208 as a frame forming the apparatus housing, the access cover unit made by incorporating the access cover 211 into the access cover base 226, the front cover 206 as a cover secured rotatably to the lower casing 207, the L-side cover 209 and the R-side cover 210 secured detachably to the lower casing 207 and the upper casing 208, a feeding cover 215 for covering the automatic sheet feeder 225, and a printer unit, not shown, contained in those outer housing members.

The recording apparatus according to the embodiment has a delivery tray unit U constituted of the first delivery tray 201, the second delivery tray 202, and the third delivery tray 203, and the delivery tray unit U is structured as contained in a retractable manner in the tray containing portion formed at a bottom of the lower casing 207. This is described below in detail later.

The lower casing 207 forms substantially the lower half of the apparatus housing, and the upper casing 208 forms substantially the upper half of the apparatus housing. The combination of both casings bring a hollow structure having a containing space for containing the printer unit inside, and an opening is formed at the top surface portion and the front surface portion, respectively.

It is to be noted that though the internal structure of the recording apparatus (i.e., printer unit) is not illustrated in detail, it is structured that the recording sheet as a recording medium set in the feeding trays 216, 217 is separately fed one by one, that recording is made by the recording means with respect to the recording sheet, and that the recording sheet already recorded is delivered on the delivery tray unit U and stacked thereon.

Now, the structure of the recording means is described briefly. The recording head as a recording means is for recording ink images on the recording sheet. As a recording means for this apparatus, an inkjet recording method in which ink is discharged out of the recording head to make recording is used. That is, the recording head includes fine fluid discharging outlets (orifices), a fluid route, an energy operation portion formed at a portion of the fluid route, and an energy generating means for generating the fluid droplet forming energy for operating the fluid located at the operation position.

As such an energy generating means for generating the energy, exemplified are a recording method using an electromechanical converter such as piezo device or the like, a recording method using an energy generating means for making heat by radiation of electromagnetic wave such as a laser or the like and discharging the droplets with operation of the generated heat, and a recording method using an energy generating means for heating the fluid with an electro-thermal converter such as a heating device having a thermal resister and discharging the fluid.

The recording head used for inkjet recording method discharging the fluid with thermal energy, inter alia, can make recording with high definition because the fluid outlet (orifices) for forming droplets to be discharged by discharging droplets for recording can be arranged in a high density. The recording head using the electro-thermal converter as the energy generating means, inter alia, is easily made compact and is advantageous because the head can be mounted with a high density and be produced with less costs.

In this embodiment, as a discharge structure for ink, it is structured to make recording by energizing the electro-thermal converter in response to a recording signal and by discharging ink through the orifices upon growth and contraction of bubbles generated in the ink in utilizing the film boiling generated in the ink from the thermal energy.

Figure 14:
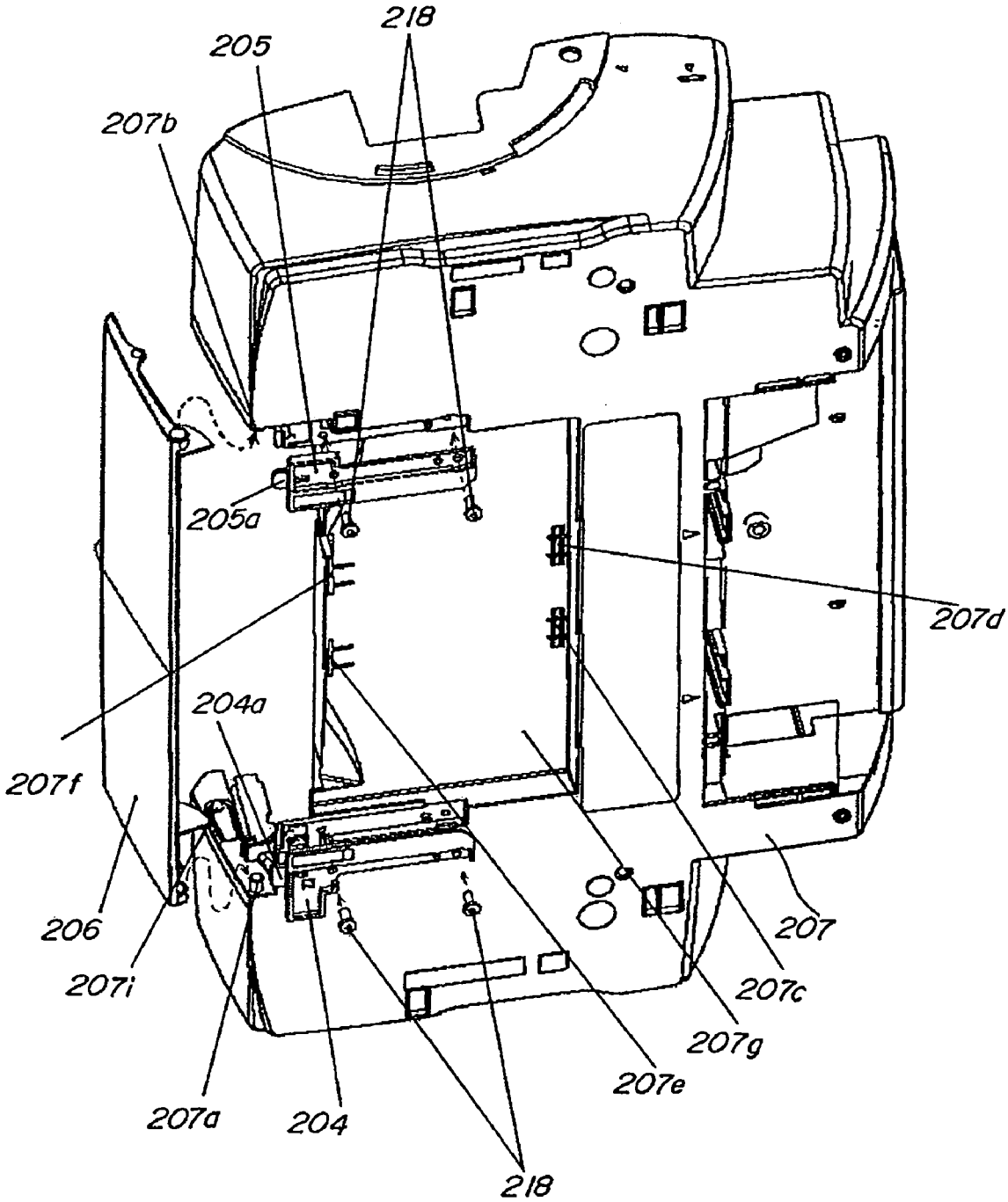
FIG. 14 is a back surface perspective view showing a lower casing of the recording apparatus according to the first embodiment.
Figure 15:
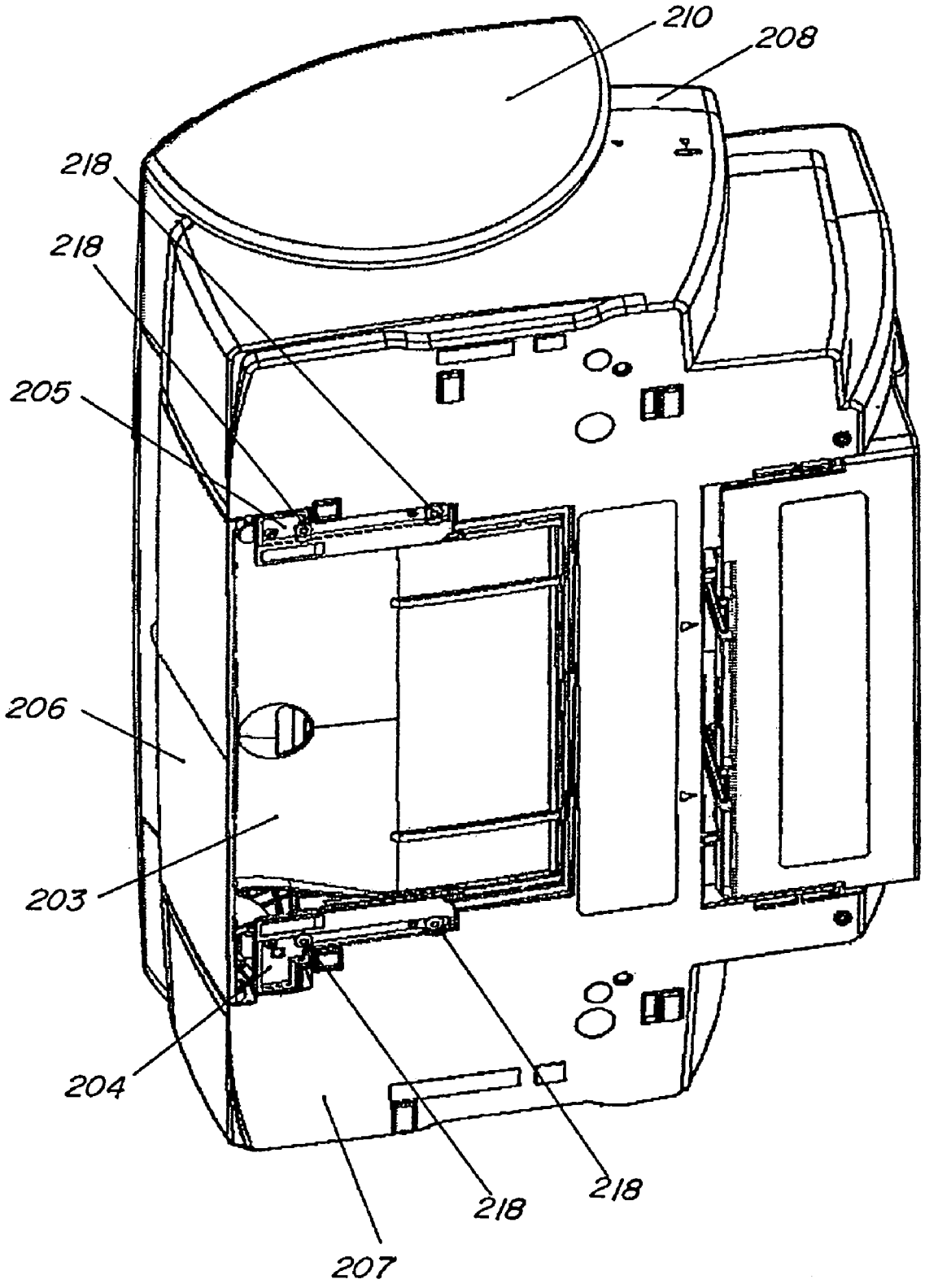
FIG. 15 is a back surface perspective view showing a recording apparatus according to first embodiment.

FIG. 14 and FIG. 15 are perspective views showing the back surface of the lower casing. As shown in FIG. 14 and FIG. 15, an L-tray rail 204 and a right R-tray rail 205 serving as a rail member are secured to a prescribed position by screws 218.

A delivery tray containing portion 207*g* for containing the delivery tray unit U is formed at a lower position of the printer, or namely at a bottom of the lower casing 207. Tongues 207*c* to 207*f* engaging to elastic tongues 201*c*, 201*d* of the first delivery tray 201 are formed at the delivery tray containing portion 207*g*. The L-tray rail 204 and the right R-tray rail 205 are secured by the screws 218 on left and right sides of the delivery tray containing portion 207*g*. During assembling time of the apparatus, after the delivery tray unit U is stored in the delivery tray containing portion 207*g*, the L-tray rail 204 and the right R-tray rail 205 are secure with screws to the lower casing 207, so that the delivery tray unit U will never drop off from the lower casing 207.

Figure 20:
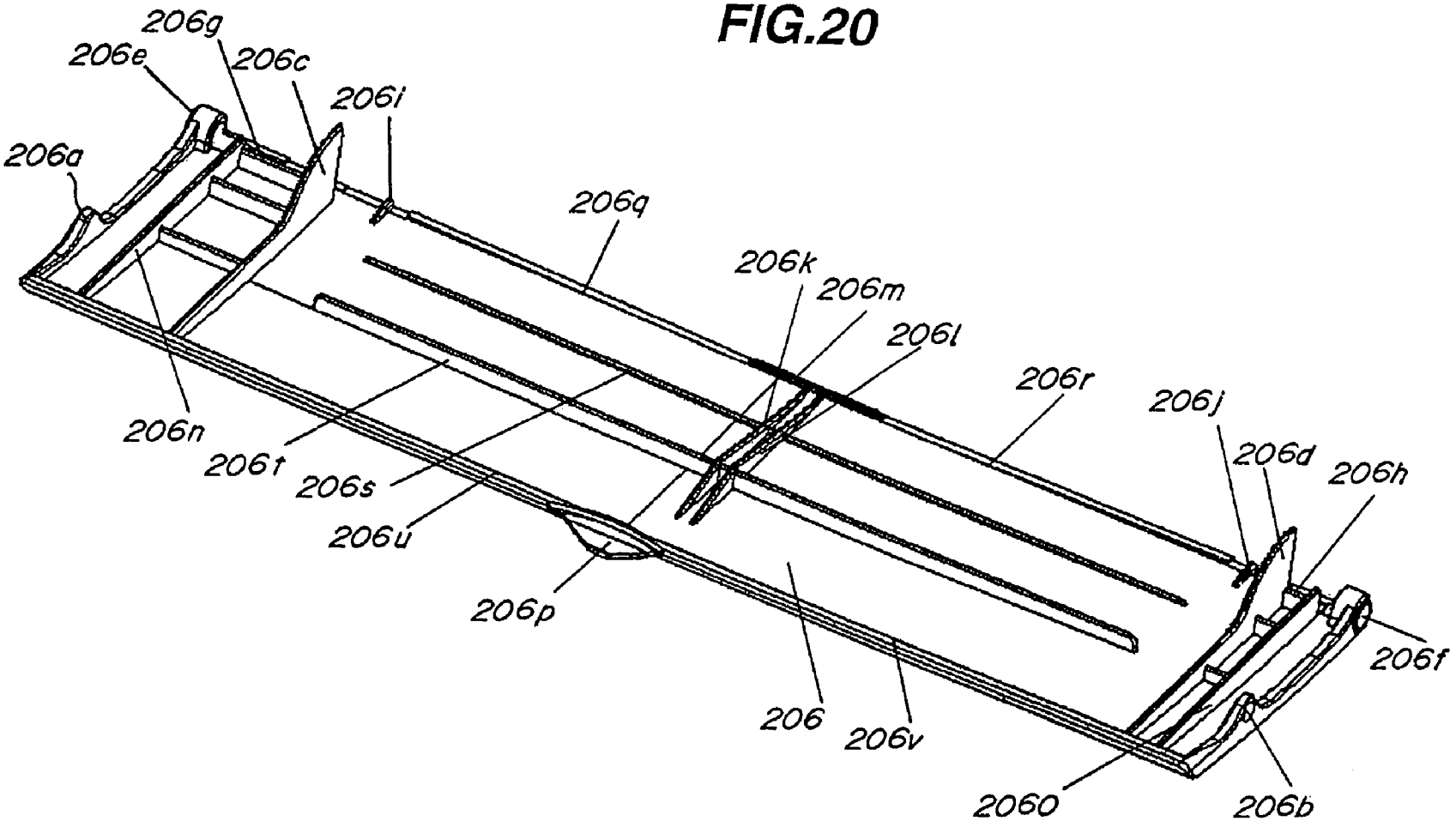
FIG. 20 is a perspective view showing a front cover according to the first embodiment.

Meanwhile, rotary shafts 207*a*, 207*b* are formed on a front surface of the lower casing 207, and bearings 206*e*, 206*f* of the front cover 206 are inserted (see, FIG. 20). This allows the front cover 206 to be attached rotatably to the lower casing 207. An elastic spring portion 207*i* is formed on a left side surface of the lower casing 207, and a protrusion is formed on the surface. When the front cover 206 is closed to shut the opening formed on the front surface of the lower casing 207, a recess 206*a* (see, FIG. 12) on the front cover 206 fits in the protrusion of the elastic spring portion 207*i* on the lower casing 207, and thereby the front cover 206 is held to the lower casing 207 as the top of the front cover 206 is in contact with a part of the upper casing 208. Because the elastic spring portion 207*i* has a proper elasticity, the spring portion can provide suitable click feelings when the front cover 106 is open and closed. It is to be noted that the elastic spring portion, not shown, is also formed on the right side of the lower casing in substantially the same manner, and a recess 206*b* (see, FIG. 12) is formed in substantially the same manner at the other end of the front cover 206.

According to the above structure, because the delivery tray unit U is held slidably to the L-tray rail 204 and the right R-tray rail 205, the front cover 206 is rotated toward the front surface of the apparatus body, when the recording operation is executed, to open the opening, and the delivery tray unit U is pulled out of the tray containing portion 207*g* of the apparatus body. The respective delivery trays are held at prescribed angles by the holding means of the delivery tray as described below; the recording sheets can be delivered from the trays; the respective recording sheets thus delivered are stacked sheet by sheet on the delivery tray pulled out. Where the respective trays are pulled out forward, the sheet supporting area for the recording sheets can be enlarged or reduced in three ways. The front end (head portion) of the first tray 201 is in an arc shape to maintain the delivery performance as described above.

The access cover base 226 has an end rotatably held to the upper casing 208 and has a structure to open and close an opening formed on a top surface of the apparatus body. The recording head cartridge, not shown, as a recording means, the ink tank, not shown, which are contained in the interior of the apparatus body, become replaceable, as well as paper jamming can be recovered, upon opening the access cover unit in which the access cover base 226 and the access cover 211 are in a united body. The access cover 211 is made of an aluminum thin plate material, and around the cover, attachment legs, not shown, are formed. The access cover 211 is held to the access cover base 226 upon inserting the attachment legs to prescribed positions of the access cover base 226 and folding the attachment legs, thereby being made as a united body as an access cover unit.

It is not illustrated herein specifically, but when the access cover is made open and closed, the projection formed on the back surface of the cover moves the cover opening closing lever, not shown, rotatably, and when the lever pushes the micro switch, opening and closing states of the access cover can be detected.

As shown in FIG. 12, the first feeding tray 201 and the second feeding tray 202 are contained as slidable at the back surface of the feeding cover 215. Where the operator makes recording, the sheet to be recorded can be held at a prescribed position of the automatic sheet feeder 225 by pulling out the respective feeding trays 201, 202 from the feeding cover 215.

On a top surface of the rear portion of the apparatus body of the upper casing 208, as shown in FIG. 12, a power key 212 and a resuming key 213 are formed so as to be pushed down, and also an LED 214 is formed and informs a recordable status upon turning on the LED 214 to the operator while the power key 212 is pushed down. More specifically, the power key 212 and the resuming key 213 are formed in a united body, and a key cap molded of a stainless thin plate in a squeezed manner at a protrusion top of the base material is attached to each key. The LED 214 has various displaying functions to inform the operator of the operation statuses or troubles of the recording apparatus by changing the way of blinking and color and beeping with a beeper, not shown. It is to be noted that when the trouble or the like is solved, recording can be resumed upon pushing the resuming key 213.

Figure 16:
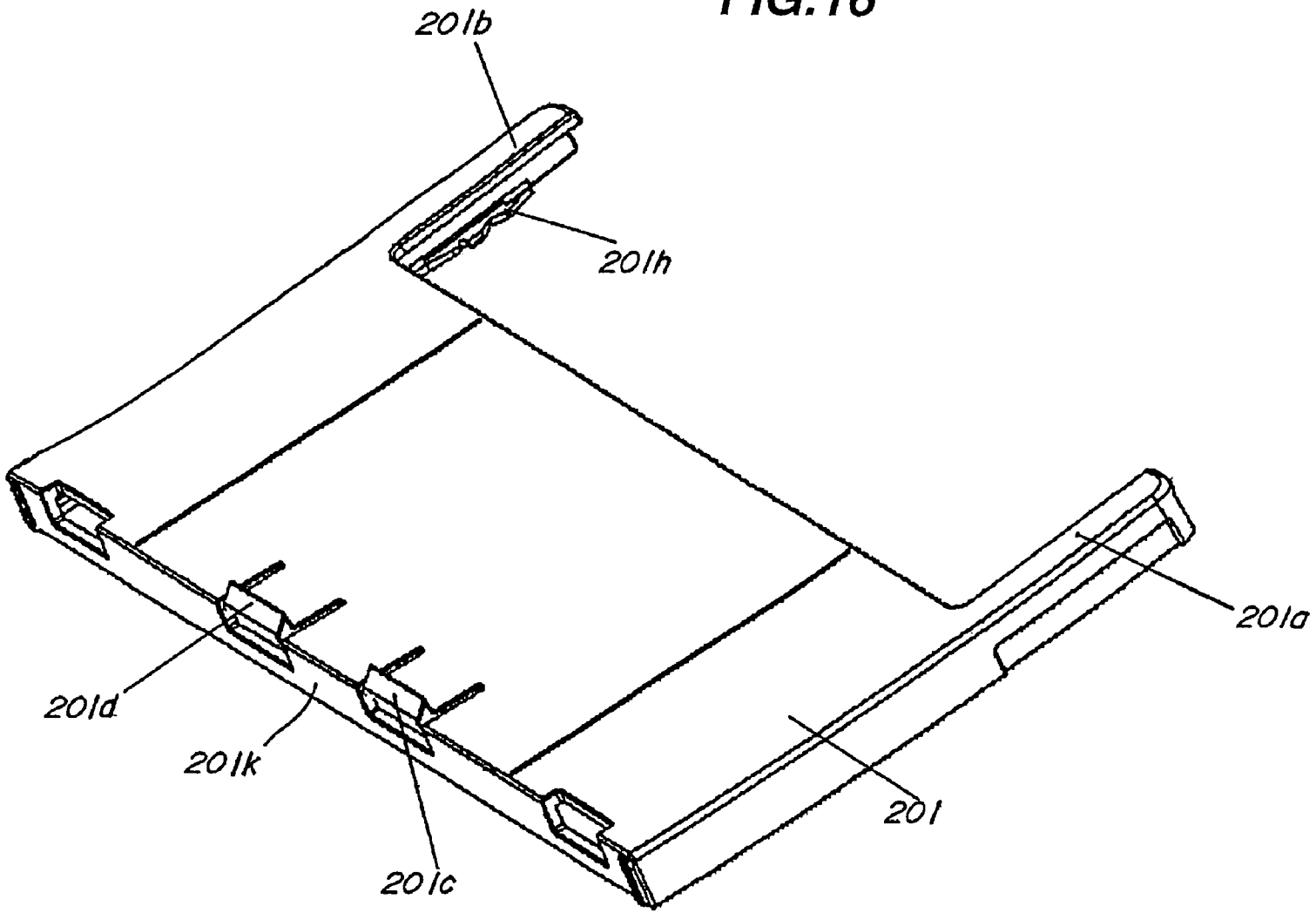
FIG. 16 is a perspective view of a first delivery tray on a side of a sheet stacking surface according to the first embodiment.
Figure 17:
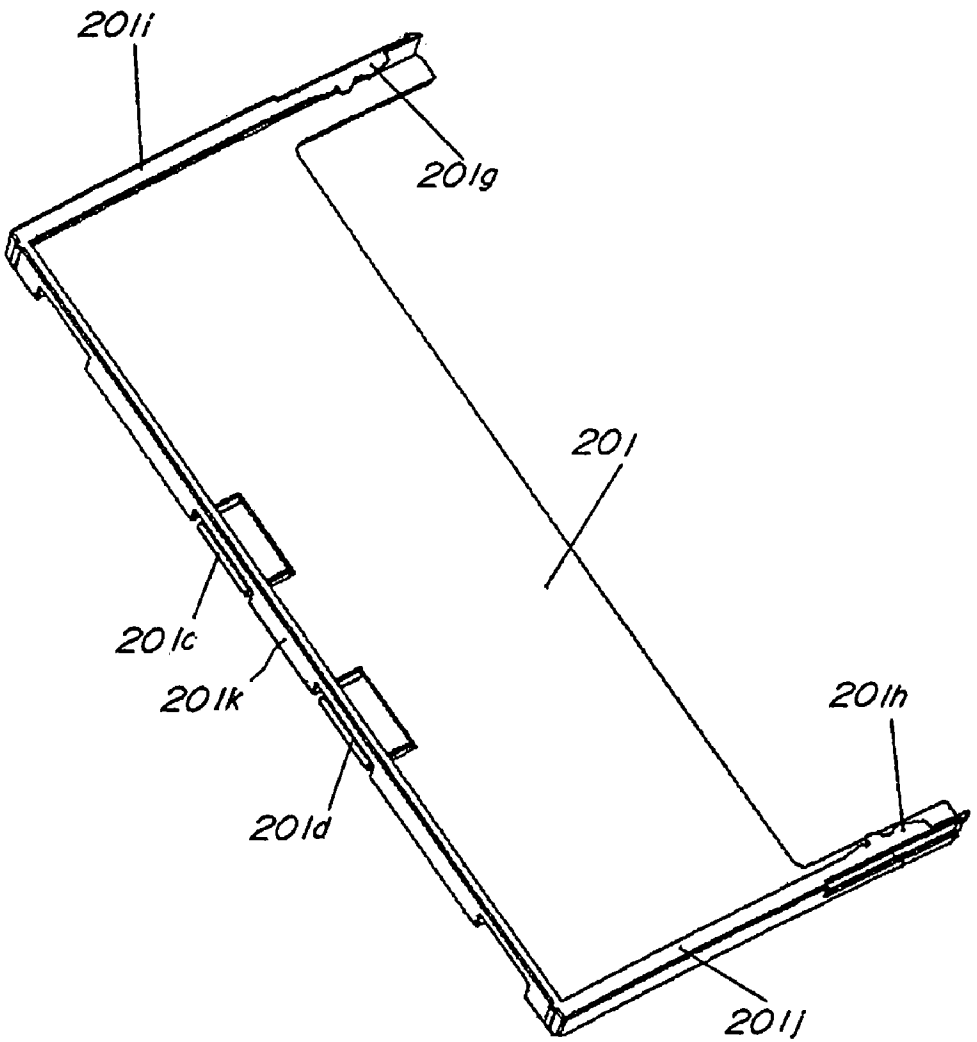
FIG. 17 is a perspective view showing a rear surface side of the first delivery tray according to the first embodiment.

FIG. 16 and FIG. 17 are perspective views showing the appearance of the first delivery tray 201. The rail portions 201*a*, 201*b* are protruded on the front surface of the first delivery tray 201 and form the sliding portion for the second delivery tray 202. Fitting portions 201*g*, 201*h* are formed respectively on a lower portion of the rail portions 201*a*, 201*b*, and secure the second delivery tray 202 at the prescribed position. A thin thickness portion is formed partly on a side surface of the rail portions 201*a*, 201*b*, thereby rendering the fitting portions 201*g*, 201*h* of the first delivery tray 201 transform easily, and rendering the fitting tongues of the second delivery tray fit with an appropriate load. That is, the second delivery tray 202 is pulled out of the thin thickness portion to render the tray have a proper click feeling when the tray is contained. Where elastic tongues 201*d*, 201*c* are formed on the sheet stacking surface, and where slit portions are formed at both sides and a lower surface of the respective elastic tongues 201*d*, 201*c*, the elastic tongues 201*d*, 201*c* are structured to be elastically transformed with a proper load exerted from an upper side. Rail portions 201*i*, 201*j* are formed on the back surface and formed in a united body with the rail portions 201*a*, 201*b*, respectively, to provide a shape that the second delivery tray 202 slides smoothly.

Figure 18:
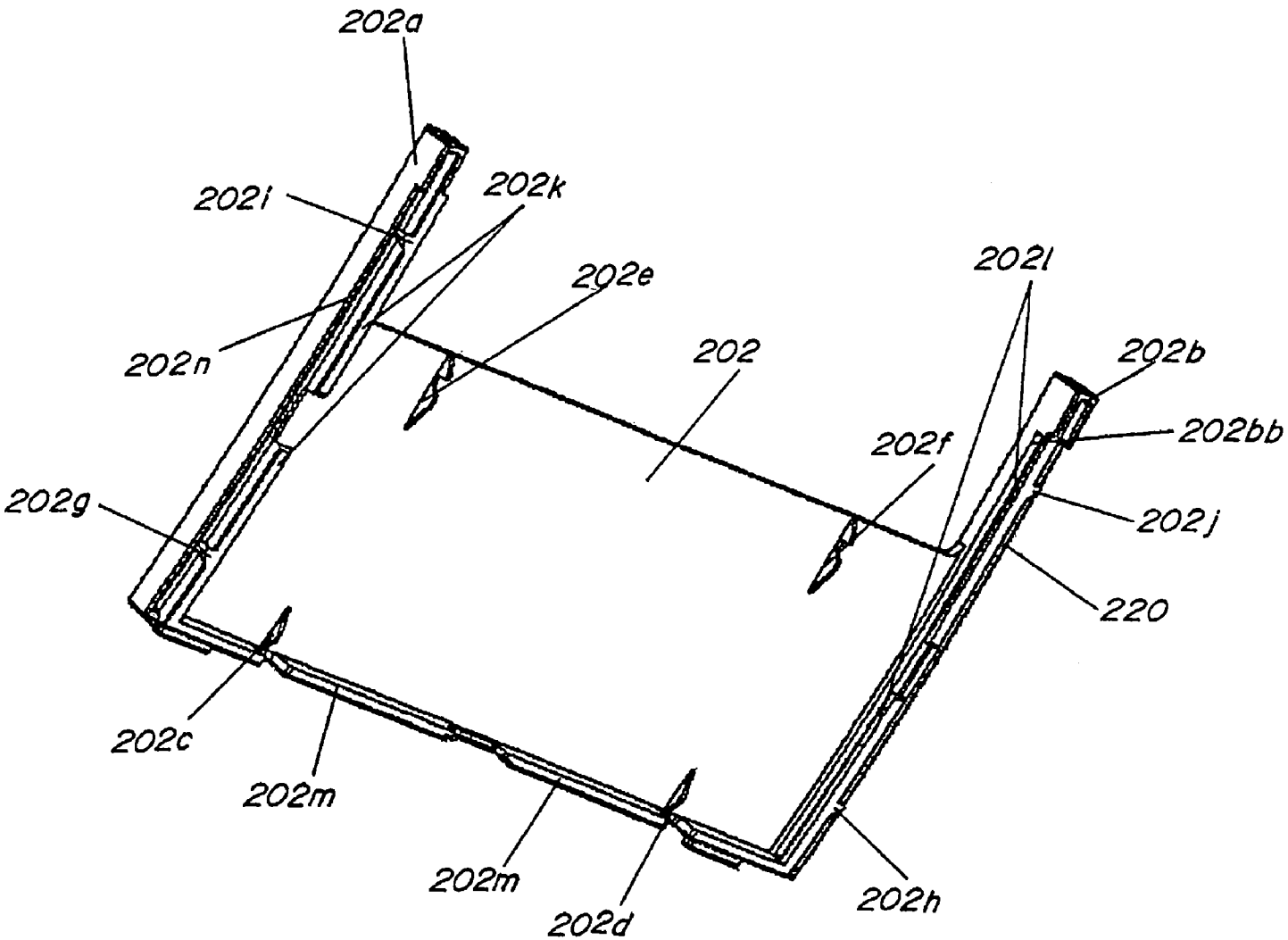
FIG. 18 is a perspective view showing a rear surface side of a second delivery tray according to the first embodiment.
Figure 22:
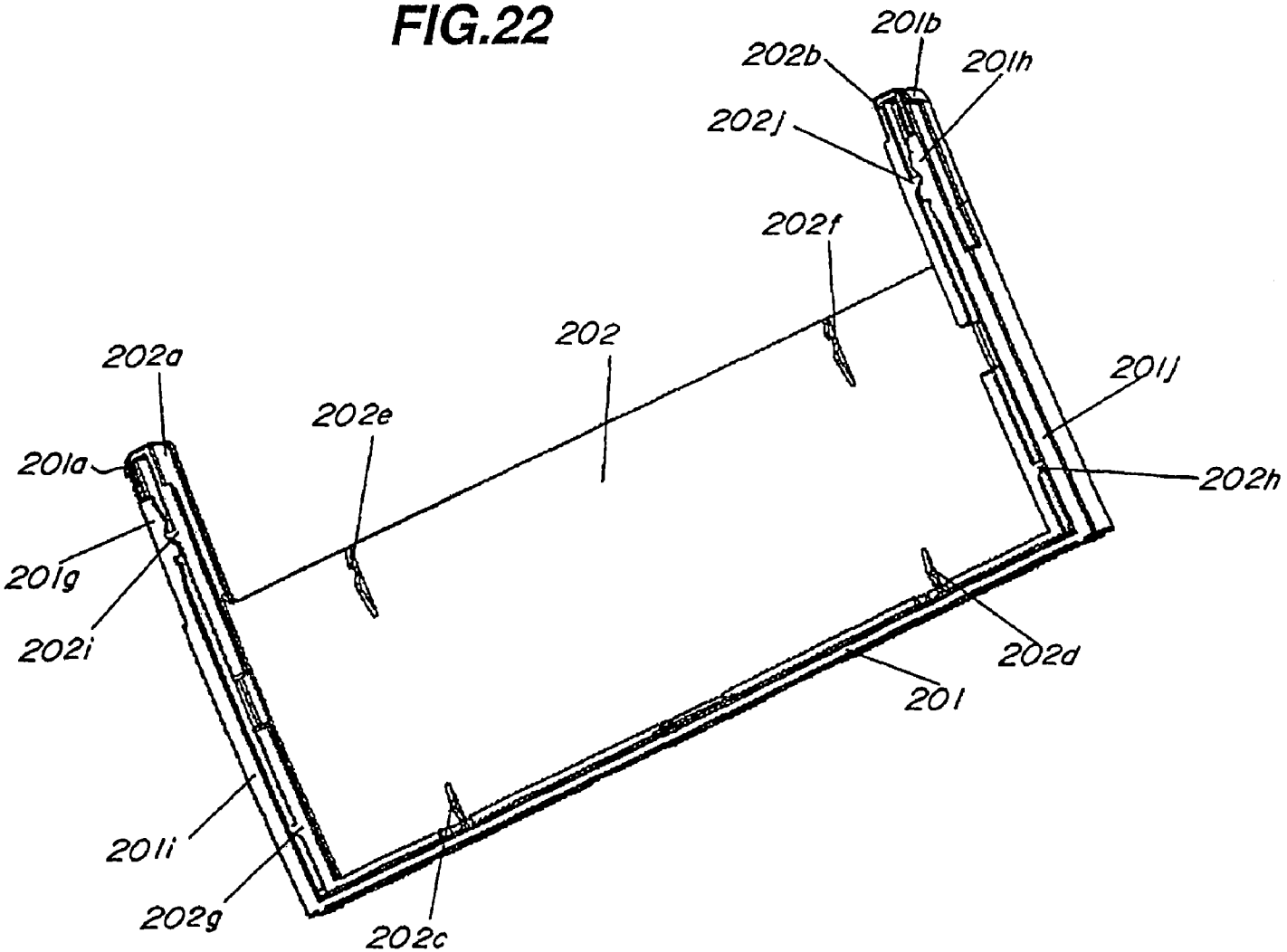
FIG. 22 is a perspective view showing the second delivery tray contained in the first delivery tray.
Figure 23:
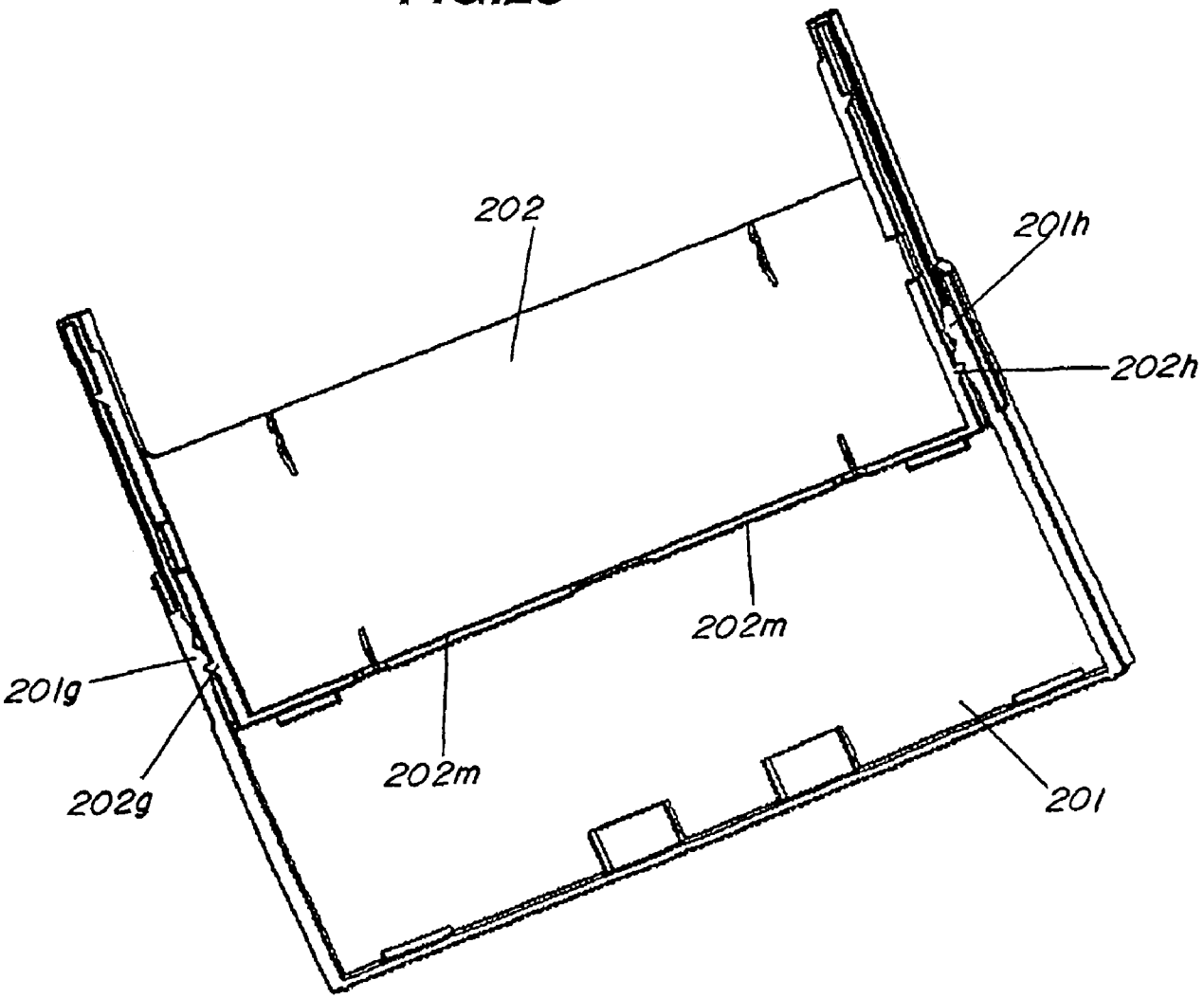
FIG. 23 is a perspective view showing the second delivery tray pulled out from the first delivery tray.

FIG. 18 is a perspective view showing the appearance (rear surface) of the second delivery tray 202. The rail portions 202*a*, 202*b* are projecting from the front surface of the second delivery tray 202, and at lower portions, respectively, rail portions 202*k*, 202*l* are formed in a united body to form sliding portions for the third delivery tray 203. Fitting tongues 202*g* to 202*j* are formed on a rear surface on the opposite side to the sheet stacking surface and are engaged with the fitting portions 201*g*, 201*h* of the first delivery tray 201 as described above. Fitting tongues 202*c* to 202*f* are formed in a serrated shape on the back surface of the second delivery tray 202. As shown in FIG. 22, when the second delivery tray 202 is contained in the first delivery tray 201, the fitting tongues 202*i*, 202*j* of the second delivery tray 202 engage with the fitting portions 201*g*, 201*h* of the first delivery tray 201, respectively. When the second delivery tray 202 is pulled out, the fitting tongues 202*i*, 202*j* of the second delivery tray 202 exceed the mountain portion of the fitting portions 201*g*, 201*h* of the first delivery tray 201 as the rail portions 201*a*, 201*b* of the first delivery tray 201 are elastically transformed, and as shown in FIG. 23, the fitting tongues 201*g*, 201*h* engage with the fitting portions 201*g*, 201*h* of the first delivery tray 201, respectively, thereby being secured with a prescribed pulling out amount.

According to the above structure, the second delivery tray 202 is held as to be retractable in the first delivery tray 201; a proper click feeling is given at a time when the second delivery tray is pulled out and contained; the second delivery tray 202 can be securely held at the prescribed pulled amount when pulled.

Figure 19:
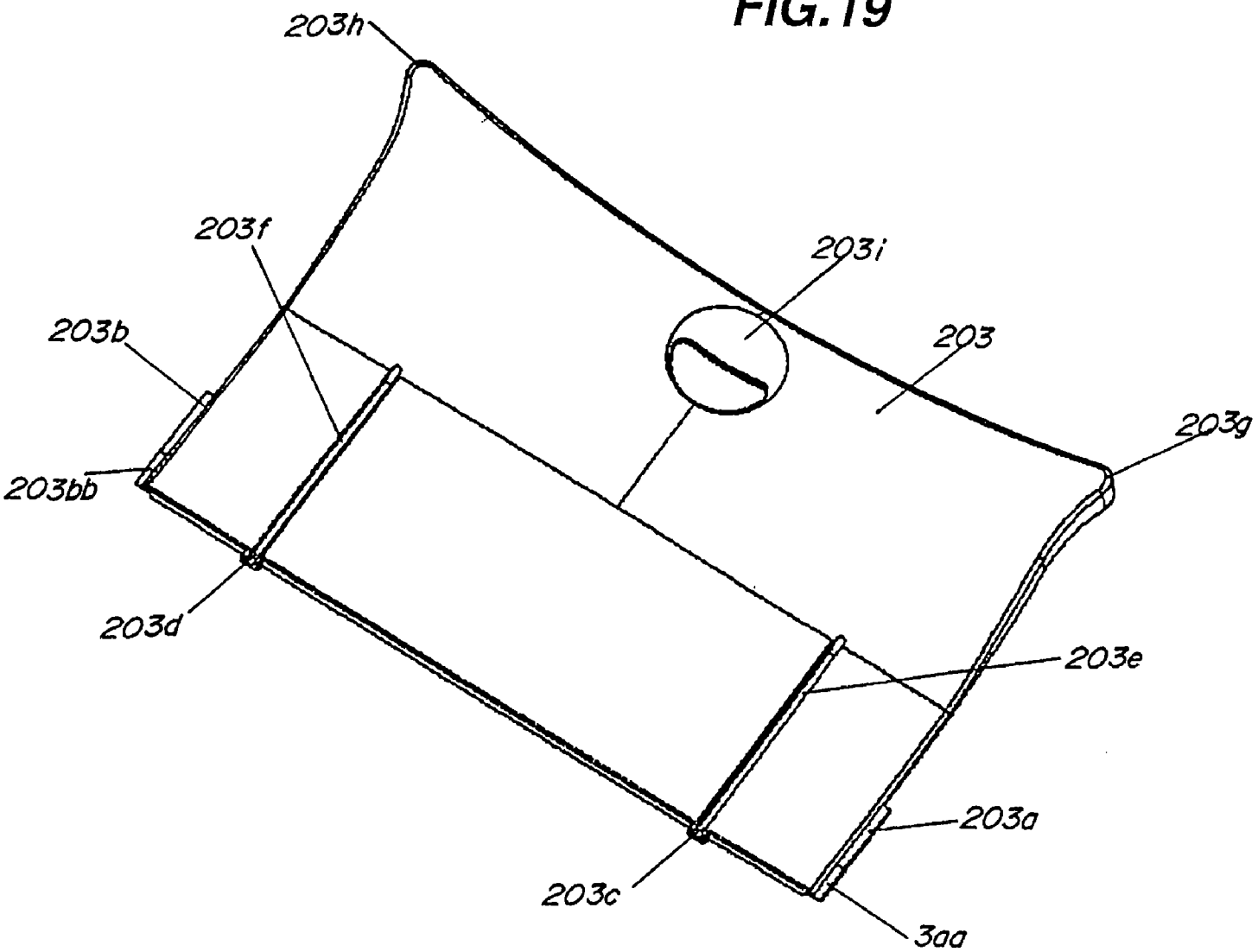
FIG. 19 is a perspective view showing a sheet stacking surface side of the third delivery tray according to the first embodiment.
Figure 24:
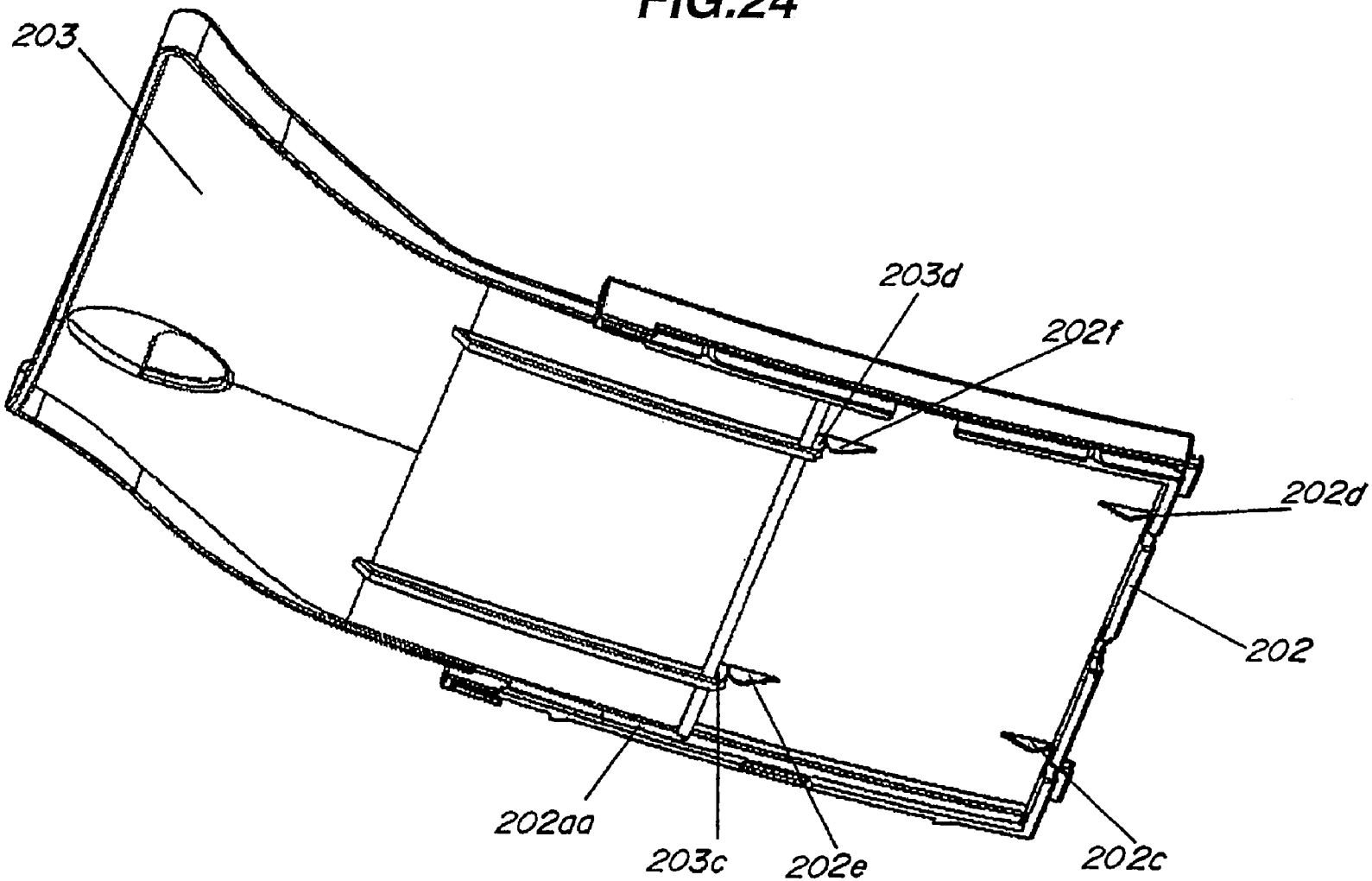
FIG. 24 is a perspective view showing the third delivery tray pulled out from the second delivery tray.

FIG. 19 is a perspective view showing an appearance of the third delivery tray. Ribs 203*a*, 203*b* are formed on both sides of the third delivery tray 203. The ribs 203*a*, 203*b* are respectively inserted to the rail portions 202*a*, 202*b* of the second delivery tray 202 described above. Steps 203*aa*, 203*bb* having a thickness thinner than the other portion are formed at the rear of the ribs 203*a*, 203*b*, and front ends 203*h*, 203*g* of the third delivery tray 203 come to suspend downward (or, namely reducing the holding angle of the delivery tray) by enlarging the widths 202*aa*, 202*bb* of the rail portions 202*a*, 202*b* of the second delivery tray 202 (see, FIG. 24, FIG. 18) and the clearance of the ribs 203*a*, 203*b* with the steps 203*aa*, 203*bb* of the third delivery tray 203 where the third delivery tray 203 is pulled out in a prescribed amount. The front ends 203*h*, 203*g* of the third delivery tray 203 are formed in an arc shape, so that this allows the delivered sheet to be held with a curvature and prevents the previously delivered sheets from messing with ink caused by the subsequently delivered sheets as well as delivery defects from occurring in which recording is worn out or the like. A handling portion 203*i* is formed at a center on the front side of the third delivery tray 203. On the other hand, grooves 203*e*, 203*f* are formed on the sheet stacking surface, and fitting tongues 203*c*, 203*d* are formed on the rear side thereof.

Figure 25:
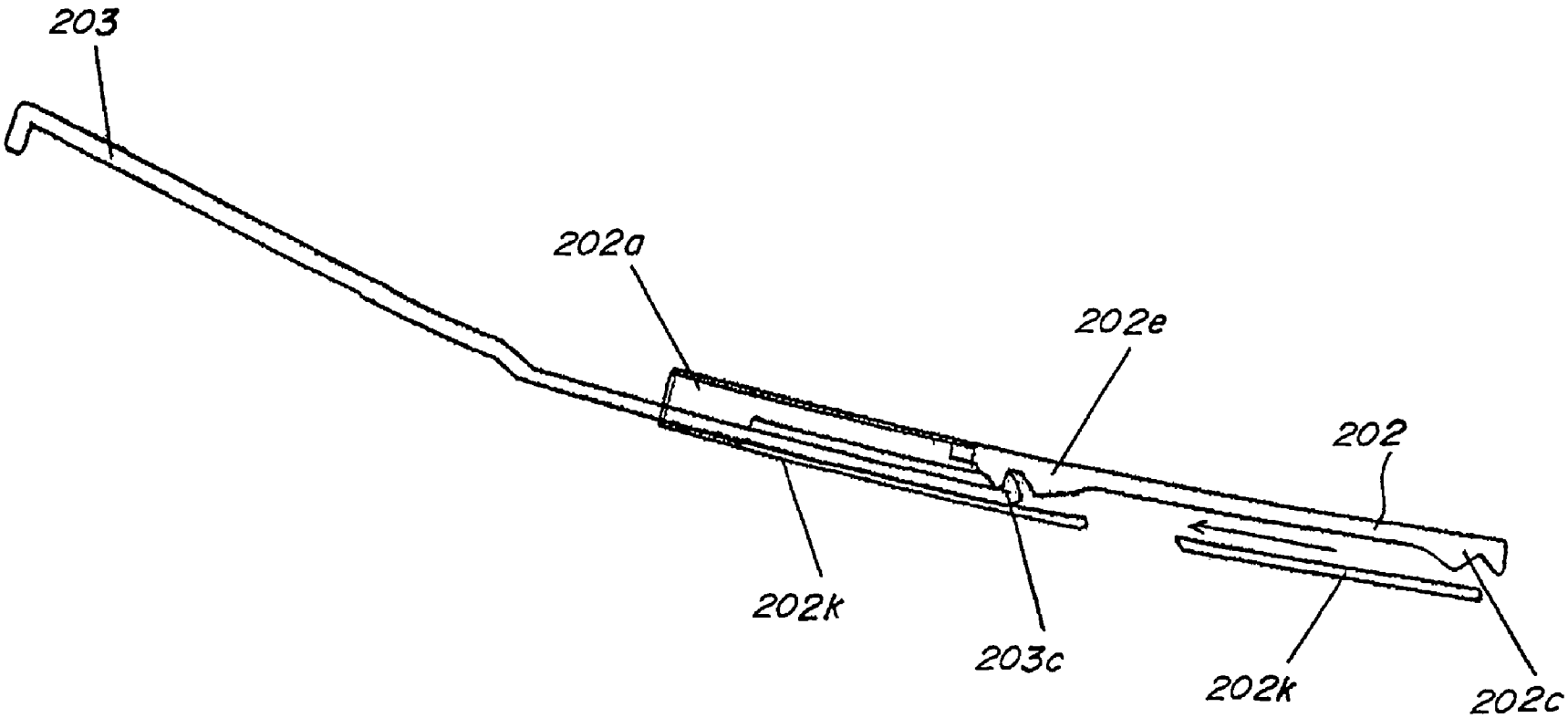
FIG. 25 is a schematic cross section showing a means engaging the second delivery tray with the third delivery tray.

FIG. 25 is a schematic cross section illustrating an engaging method between the second delivery tray 202 and the third delivery tray 203. It is to be noted that the second delivery tray 202 and the third delivery tray 203 are symmetric with respect to a center line extending in the sheet conveyance direction, and the engaging method is done in substantially the same way on the left and right sides, so that the engaging method on one side in the width direction perpendicular to the sheet conveyance direction is exemplified. Where the third delivery tray 203 is contained in the second delivery tray 202, the fitting tongue 203*c* of the third delivery tray 203 engages to a valley portion of the fitting tongue 202*c* of the second delivery tray 202. As shown in FIG. 25, if the third delivery tray 203 is pulled out from the second delivery tray 202, the second delivery tray 202 is subject to an elastic transformation in a upwardly convex shape, and the fitting tongue 203*c* of the third delivery tray 203 comes over the mountain portion of the fitting tongue 202*c* of the second delivery tray 202 and reaches the fitting tongue 202*e*. Where the third delivery tray 203 is pulled out, the second delivery tray 203 again is subject to an elastic transformation in a upwardly convex shape, and the fitting tongue 203*c* of the third delivery tray 203 comes over the mountain portion of the fitting tongue 202*e* of the second delivery tray 202 and engages with the valley portion. Where the distance between the fitting tongue 202*c* and the fitting tongue 202*e* of the second delivery tray 202 is preset to be a necessary amount, the third delivery tray 203 can be pulled in the prescribed amount with the above structure, and the tray can be securely held thereat.

Figure 21:
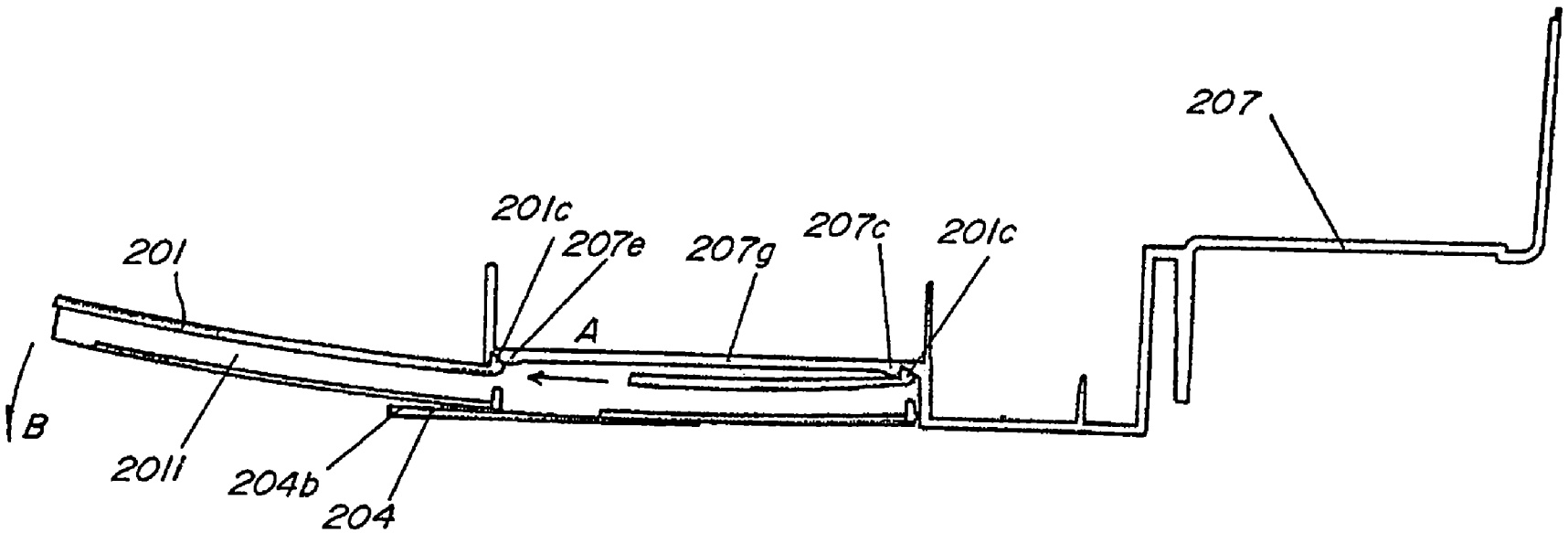
FIG. 21 is a schematic cross section showing a means engaging the first delivery tray with the lower casing.

FIG. 21 is a schematic cross section for illustrating an engaging method of the lower casing 207 and the first delivery tray 201. Herein also, the delivery tray containing portion 207*g* of the lower casing 207 and the first delivery tray 201 are symmetric with respect to a center line extending in the sheet conveyance direction, and the engaging method is done in substantially the same way on the left and right sides, so that the engaging method on one side in the width direction perpendicular to the sheet conveyance direction is exemplified.

Where the first delivery tray 201 is contained in the delivery tray containing portion 207*g*, the fitting tongue 201*c* of the first delivery tray 201 is engaged with the tongue 207*c* of the delivery tray containing portion 207*g*. When the first delivery tray 201 is pulled out of the delivery tray containing portion 207*g* in a direction of arrow A in FIG. 21, the fitting tongue 201*c* of the first delivery tray 201 comes to be loosened downward to begin passing over the tongue 207*c* of the tray containing portion 207*g*. Where the first delivery tray 201 is further pulled out, the fitting tongue 201*c* passes over the tongue 207*c* and approaches to the tongue 207*e*. When the tray 201 reaches the prescribed pulled amount, the fitting tongue 201*c* falls in the valley portion of the tongue 207*e*, and the first delivery tray 201 cannot be pulled out further from the shape of the fitting tongue 201*c* and the tongue 207*e*. Where the first delivery tray 201 is pulled out in the prescribed amount from the tray containing portion 207*g*, the front side on the tray sliding surface of the L-tray rail 204 becomes a slope partly, and a lower portion of the first delivery tray 201 comes in contact with the slope 204*b*, thereby suspending the front end of the first delivery tray 201 downward (namely, substantially rotating in the direction of arrow B in FIG. 21). When the first delivery tray 201 is contained in the delivery tray containing portion 207*g*, the front end of the first delivery tray 201 is pushed down rearward to disengage the engagement of the tongue 207*e* of the delivery tray containing portion 207*g* by elastic transformation of the elastic tongue 201*c*, and the elastic tongue 201*c* engages to the tongue 207*c* upon containing the tray 201 in a direction opposite to the direction of arrow A in FIG. 21, thereby securely holding the first delivery tray 201 at a prescribed position. The elastic tongue 201*c* of the first delivery tray 201 is designed to be loosened with a proper elasticity, and the tongue shape of the delivery tray containing portion 207*g* is in mountain and valley shape, so that a proper click feeling can be obtained at a time when the tray is pulled out and contained.

Figure 26:
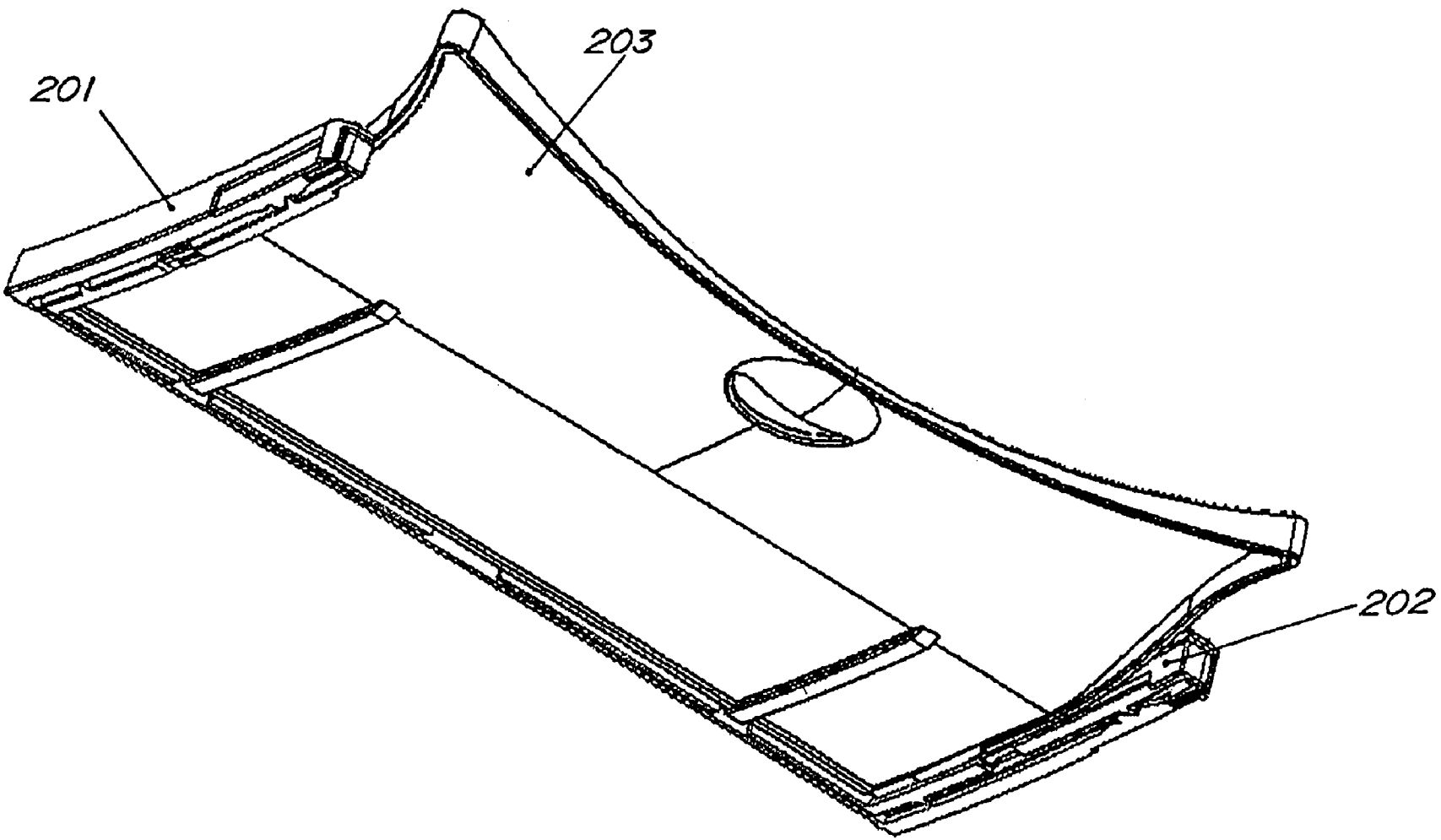
FIG. 26 is a perspective view showing a situation that the second delivery tray and the third delivery tray are contained, respectively.

FIG. 26 is a perspective view showing a state in which the first delivery tray 201, the second delivery tray 202, and the third delivery tray 203 are respectively contained. Under this state, the delivery tray unit U constituted of the first delivery tray 201, the second delivery tray 202, and the third delivery tray 203 is incorporated in the delivery tray containing portion 207*g* formed at a bottom of the lower casing 207.

Figure 27:
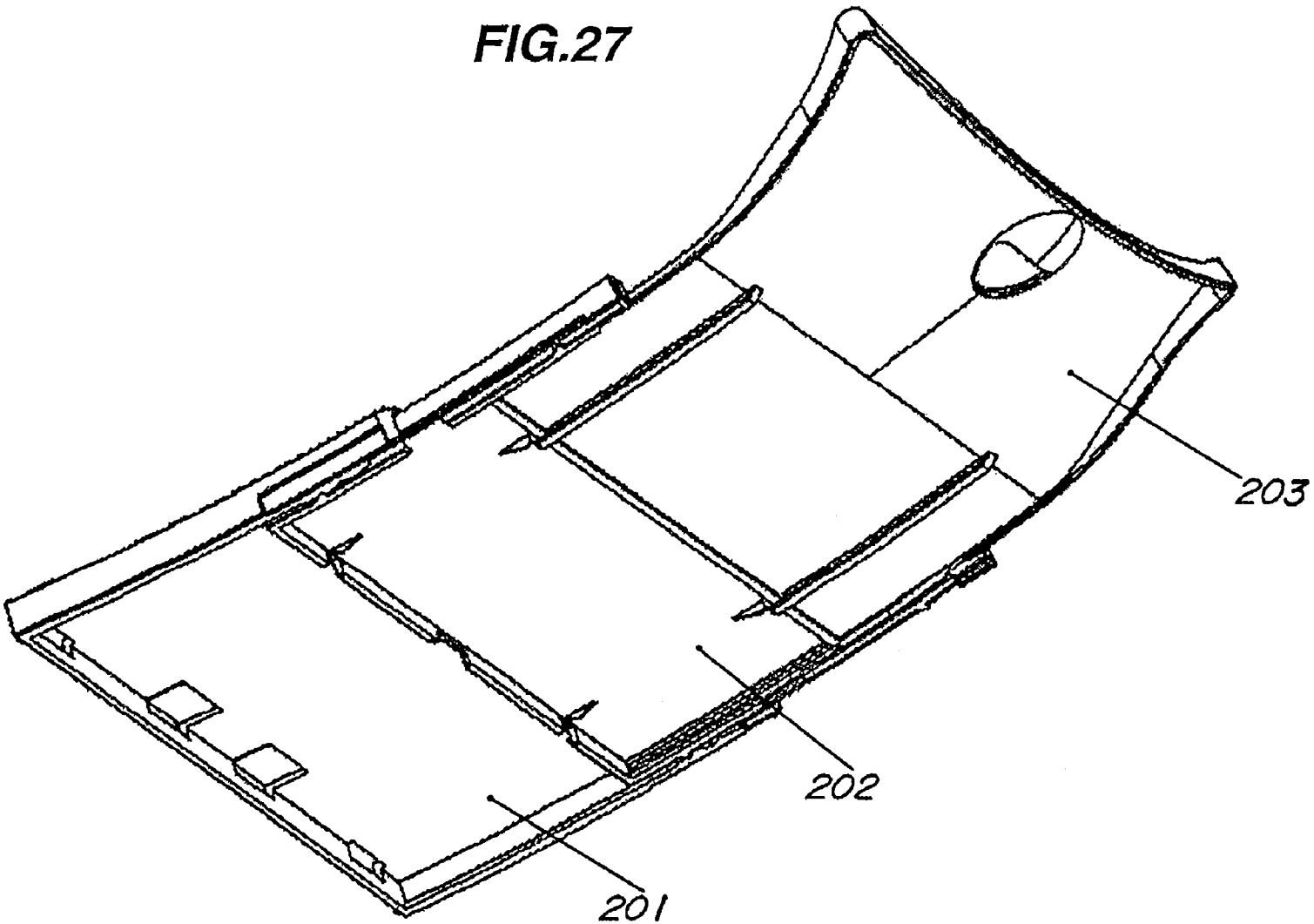
FIG. 27 is a perspective view showing a situation that the second delivery tray and the third delivery tray are pulled out, respectively.

FIG. 27 is a perspective view showing a state in which the first delivery tray 201, the second delivery tray 202, and the third delivery tray 203 are respectively pulled out up to the prescribed amounts.

With this structure, where the delivery trays 201, 202, 203 are pulled out sequentially from the tray containing portion 207*g* at the bottom of the apparatus body, the rail portions 202*n*, 202*o* of the second delivery tray 202 (see, FIG. 18) respectively contact with edges 206*u*, 206*v* of the front cover 206. Because the position of the front cover 206 is restricted by the L-tray rail 204 and the R-tray rail 205, the delivery trays do not fall downward more than needed and can be maintained at the prescribed positions even where the sheets are sequentially stacked on the sheet stacking surface of the delivery tray and where the weight of the sheets are increased so much.

In the recording apparatus according to this embodiment, the front end of the third delivery tray 203 is formed in the arc shape to maintain the delivery performance of the recording medium, and the front ends of the first delivery tray 201 and the third delivery tray 203 are structured to be suspended downward to reduce the level of the front ends. To reduce the height of the front end of the third delivery tray 203, the delivery trays are structured to be pulled and be contained at a position close to a floor level.

On the other hand, the first delivery tray 201 and the second delivery tray 202 are formed with an upright wall 201*k* and an upright wall 202*m* on the rear portion thereof, respectively, to keep the strength as shown in FIG. 16 to FIG. 18, and are formed in a box shape by a combination of the rails 201*a*, 201*b* and 202*a*, 202*b* located on both ends in the sheet width direction.

FIG. 20 is a perspective view of a back surface of the front cover attached to the recording apparatus according to the invention. The back surface of the front cover 206 is formed with sheet holding ribs 206*c*, 206*d* for supporting the rear end of a special sheet, contact surfaces 206*g*, 206*h* in contact with the lower surfaces 204*a*, 205*a* of the L-tray rail 204 and the R-tray rail 205, projections 206*i*, 206*j* rendering the second delivery tray 202 described below floating, guide ribs 206*k*, 206*l* sliding the handling portion 203*i* of the third delivery tray 203 when the delivery trays are pulled out, a rib 206*m* for protecting fingers of the operator when the delivery tray unit is pulled out, the guide ribs 206*n*, 206*o* for attaching a CD-R tray unit, and reinforcement ribs 206*s*, 206*t*.

With the above structure, where the operator grasps the handling portion 206*p* of the front cover 206 to rotate the cover forward, the contact surfaces 206*g*, 206*h* of the front cover 206 come in contact with the lower surfaces 204*a*, 205*a* of the L-tray rail 204 and the R-tray rail 205 as shown in FIG. 14, respectively, thereby holding the front cover 206 at the prescribed position (angle). Next, the operator conducts a motion to pull out the delivery trays. The operator pulls forward the cover by engaging the handling portion 203*i* of the third delivery tray 203 with a finger tip. At that time, because the bottom of the handling portion 203*i* slides as contacting to the top surfaces of the guide ribs 206*k*, 206*l*, the trays can be pulled and contained without engaging the reinforcement ribs 206*s*, 206*t*.

The delivery tray (the delivery tray unit U) pulled out of the tray containing portion 207*g* is supported on the back surface side of the front cover 206 as a cover held at the prescribed position as described above.

As described above, since the sliding position of the delivery trays is low, the upright wall 202*m* of the second ray 202 may engage with the edges 206*q*, 206*r* of the front cover 206 when the delivery trays are pulled out. It is therefore structured that projections 206*i*, 206*j* are formed at the front cover 206 to render the rail portions 202*k*, 202*l* of the second delivery tray 202 slidably contact with the projections 206*i*, 206*j*, thereby rendering the delivery trays contained and pulled out while temporarily floated when the rail portions 202*k*, 202*l* of the second delivery tray 202 pass by the edges 206*q*, 206*r* of the front cover 206. This prevents the upright wall 202*m* of the second delivery tray 202 from engaging with the edges 206*q*, 206*r* of the front cover 206.

In the recording apparatus according to the embodiment, as shown in FIG. 20, the sheet holding ribs 206*c*, 206*d*, the guide ribs 206*k*, 206*l*, and the guide ribs 206*n*, 206*o* for the CD-R tray unit are formed on the back surface of the front cover 206 in parallel to the sheet delivery direction, so that the sheet is delivered through the gap because the gap is located between the front cover 206 and the upper casing 208 even where the recording operation is made as the front cover 206 is closed. Accordingly, even where the recording operation is made as the front cover 206 is closed, jamming of the sheets may not occur.

Because in this embodiment the top surfaces of the guide ribs 206*k*, 206*l* have a proper slope, the top surfaces of the guide ribs 206*k*, 206*l* come in contact with the front surface of the third delivery tray 203 when the operator tries to shut the front cover 206 in forgetting the delivery trays (delivery tray unit) to be contained in the apparatus body (the tray containing portion). Where the front cover 206 is further rotated, the guide ribs 206*k*, 206*l* push down rearward the front surface of the third delivery tray 203, and also push down sequentially the second delivery tray 202 and the first delivery tray 201, so that the delivery trays are completely contained in the delivery tray containing portion 207*g* of the lower casing 207 when the front cover 206 is closed completely.

As described above, according to this embodiment, the front cover capable of closing the opening for delivering the sheets is formed pivotally to the lower casing having the opening, and the tray containing portion is formed at the apparatus body bottom for containing the delivery tray unit divided into three steps in the retractable manner, so that the conventional problems are solved, and so that the compact, high performance recording apparatus can be provided with excellence in industrial design and controllability.

Sixth Embodiment

Figure 28:
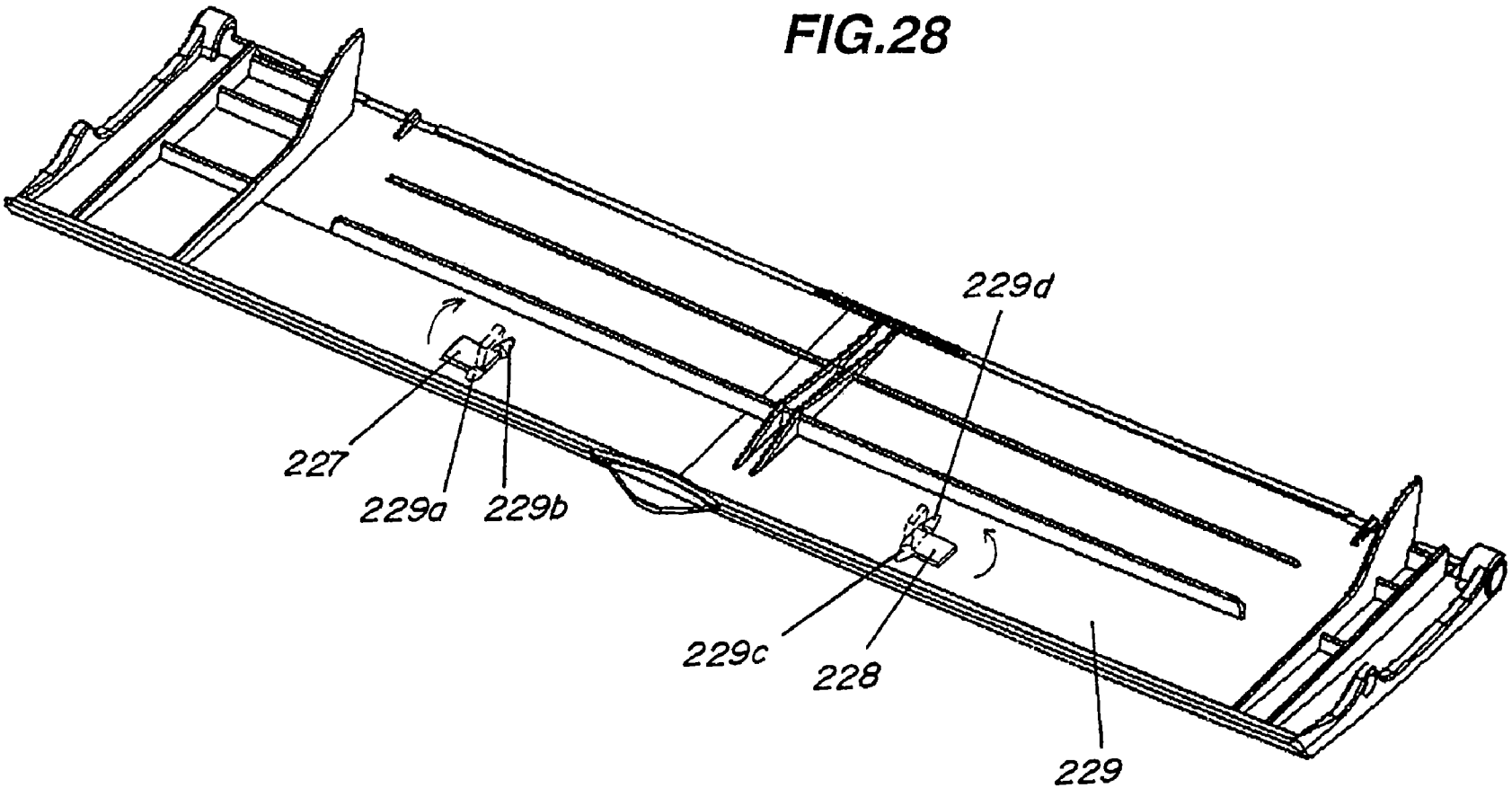
FIG. 28 is a perspective view showing a front cover according to the second embodiment.
Figure 29:
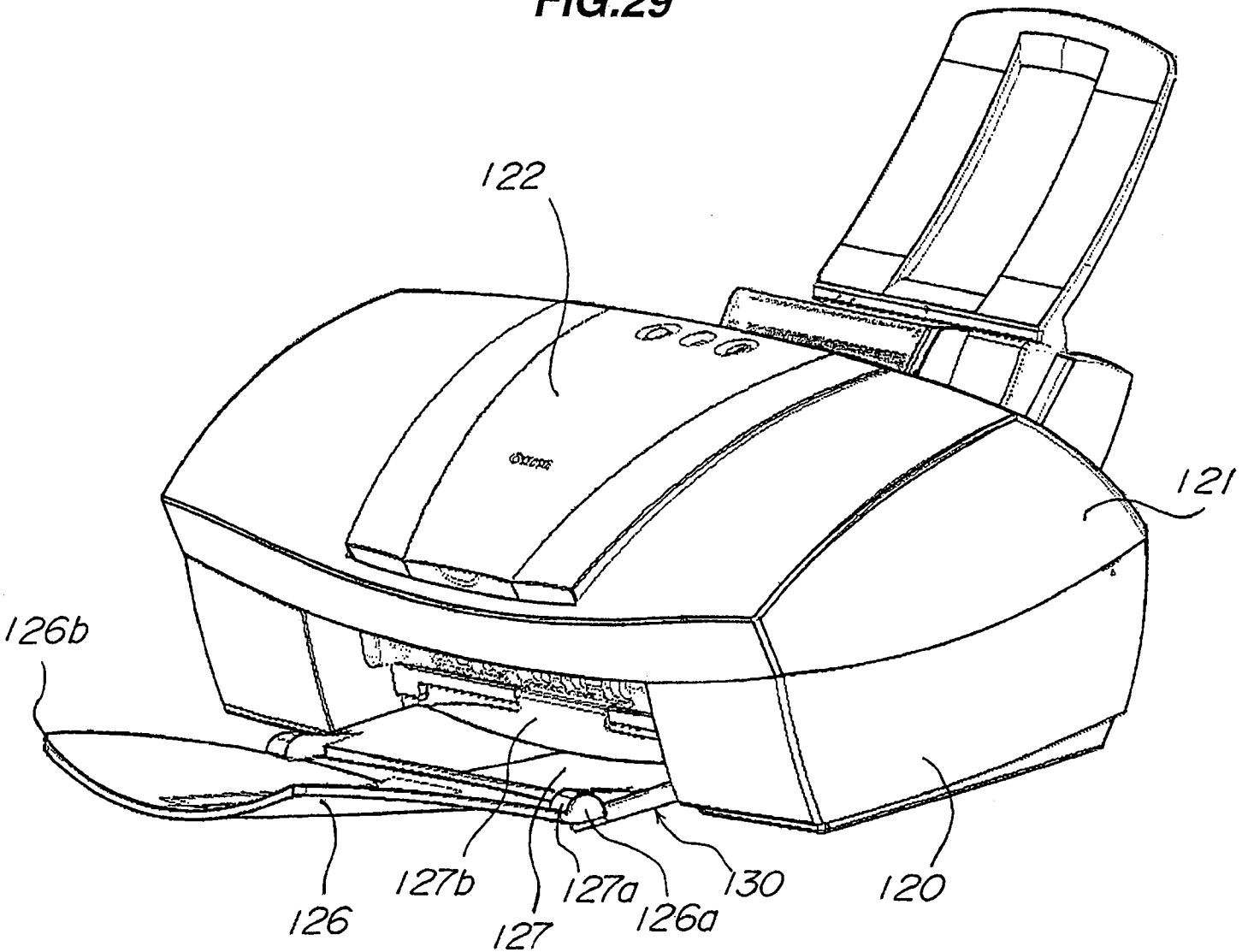
FIG. 29 is a perspective view showing a conventional recording apparatus.
Figure 30:
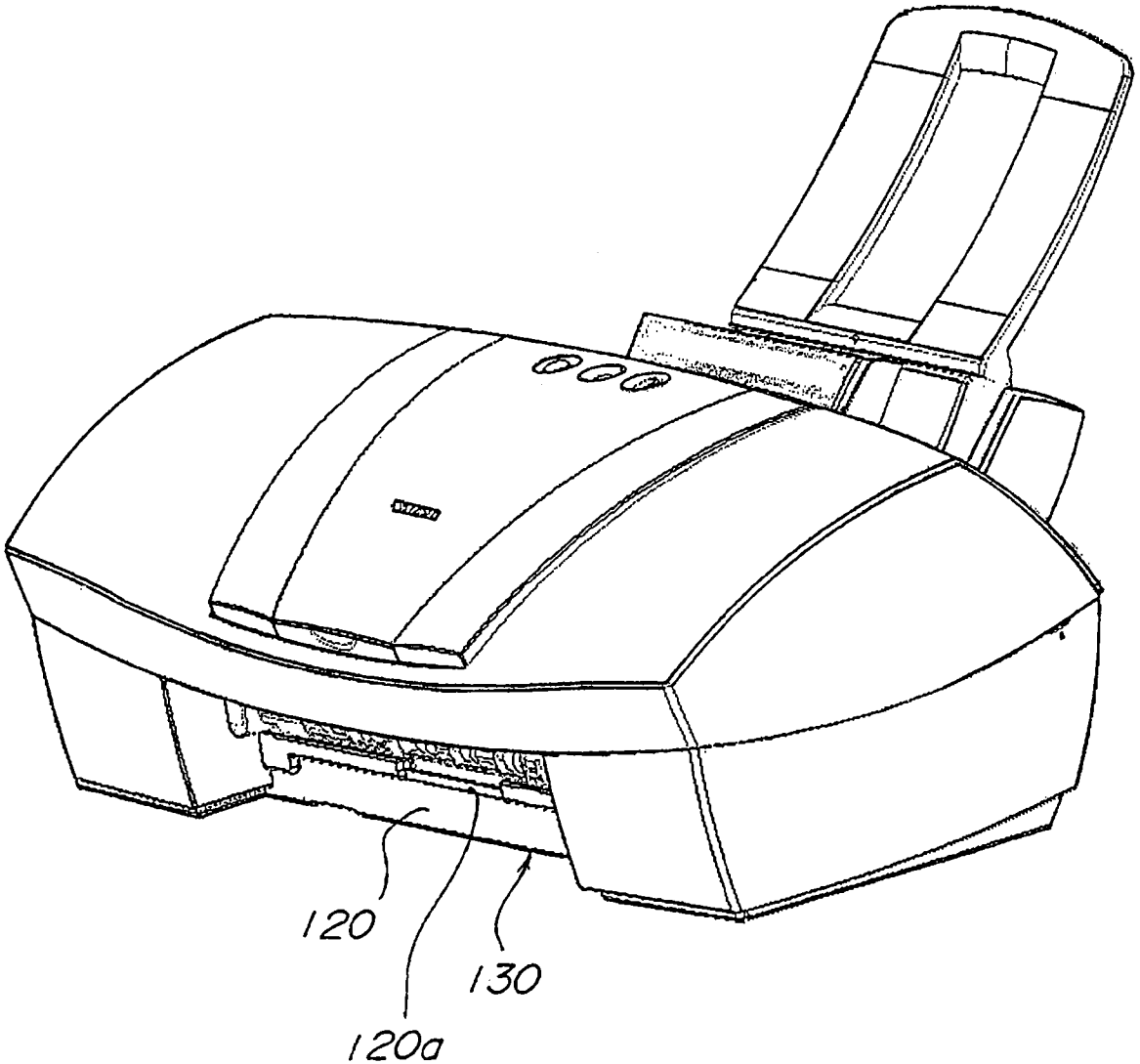
FIG. 30 is a perspective view showing the conventional recording apparatus when the delivery tray is removed.
Figure 31:
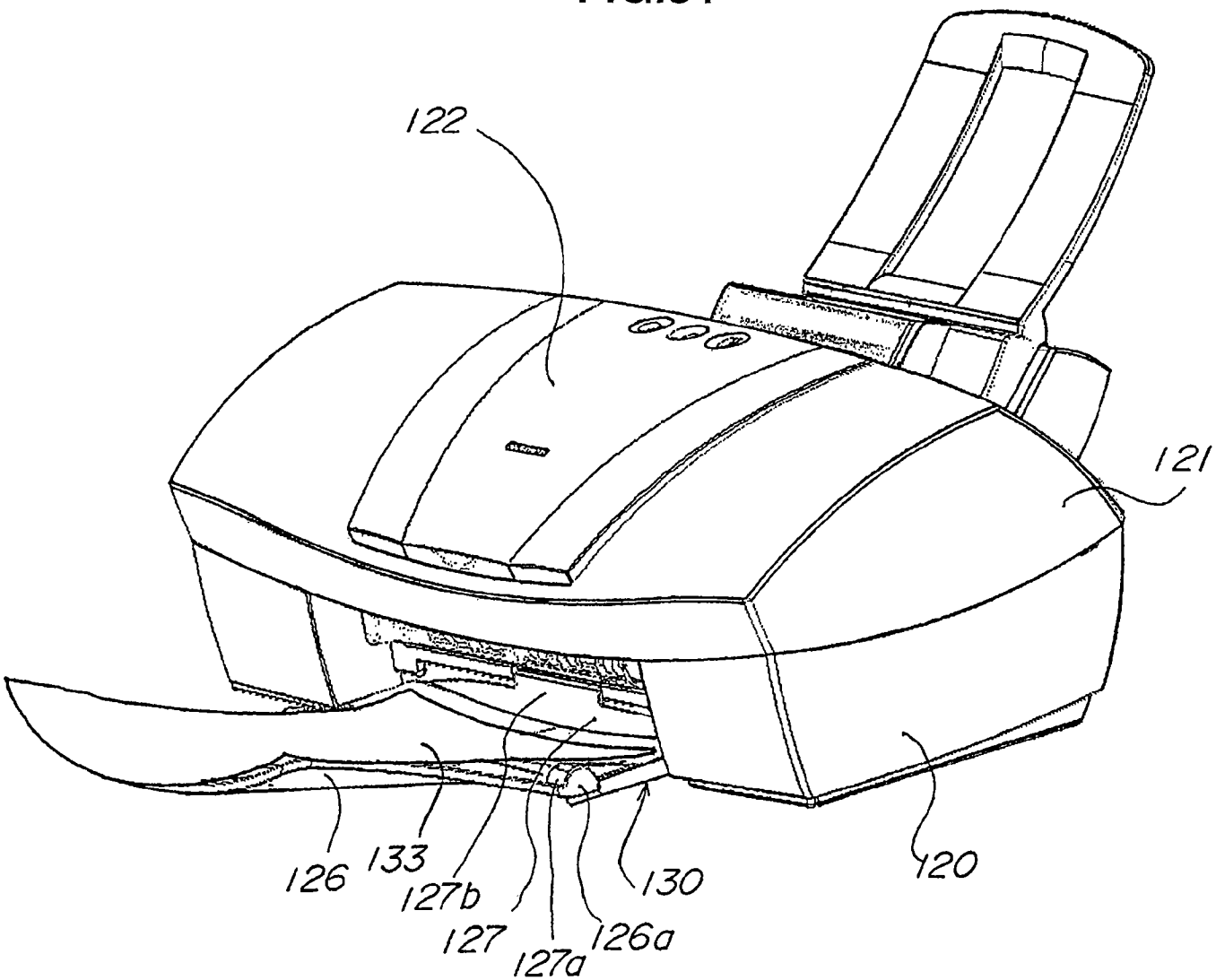
FIG. 31 is a perspective view showing the conventional recording apparatus when the sheets are stacked on the delivery tray.

FIG. 28 is a perspective view showing a front cover in the sixth embodiment. As shown in FIG. 28, a front cover 229, an L-level adjusting rib 227, a R-level adjusting rib 228 are formed at the second delivery tray 202. The portions whose descriptions can be overlapped with those in the fifth embodiment are assigned with the same reference numbers, and the descriptions are omitted.

Bearings 229*a* to 229*d* are formed on the back surface of the front cover 229, and shafts, not shown, for the level adjusting ribs 227, 228 are inserted to the bearings. With this structure, the level adjusting ribs 227, 228 can be held in an upright state with a locking mechanism not shown, and are not subject to a loosened state when the front cover 229 is closed because can be held closely to the front cover 229 when fallen down. Where the delivery tray is pulled out as the level adjusting ribs 227, 228 are in the upright state, a part of the delivery tray comes in contact with the top surface of the level adjusting ribs 227, 228, so that the position of the delivery tray can be high when the delivery trays are pulled out.

According to the above structure, the level of the delivery trays can be adjusted in association with the kind of the delivered sheets, where, e.g., the level adjusting ribs 227, 228 are folded in a case that the rigid sheets are stacked and made upright in a case that the non-rigid sheets are stacked.

Where a printer unit having the different delivery rate (or recording rate) is mounted, this structure brings an advantage that the apparatus body does not need major changes because the level of the delivery trays can be adjusted.

For example, in this embodiment, the level adjusting ribs are placed at two locations, but substantially the same advantage can be obtained with a single location of the level adjusting rib.

In this embodiment, the level adjusting ribs (separate members) are formed to adjust the level of the delivery trays, but this invention is not limited to this. For example, where the shape of the level adjusting ribs is corresponded to a shape of male and female molds, front covers having various rib level can be formed in a united body. By producing the front covers having ribs in a shape suitable for the delivery rate (or recording rate) of the respective printer units, the above advantage (cost reduction advantage) can be obtained without using the level adjusting ribs (separate members).

Other Embodiment

In the embodiments described above, the number and the kind of the recording heads are not exemplified specifically, but this invention is applicable to, notwithstanding of the number and the kind of the recording heads, such as an inkjet recording apparatus using a single recording head, an inkjet recording apparatus for color recording using a plurality of recording heads making recording with inks in different colors, and an inkjet recording apparatus for grayscale recording using a plurality of recording heads recording with inks having different density of the same color, and the advantages described above can be achieved.

As a recording means (recording head), this invention is applicable to any structure of the recording means and ink tank, such as a cartridge type in which the recording head and the ink tank are formed in a united body, and a structure in which the recording head and the ink tank are formed as separated bodies which are coupled with an ink supplying tube, in substantially the same way, and substantially the same advantages can be obtained.

It is to be noted that in a case that this invention applies to the inkjet recording apparatus, for example, this invention is applicable to an apparatus using a recording means using an electromechanical converter or the like such as a piezo device, and an excellent advantage can be found in, inter alia, an inkjet recording apparatus using the recording means in which ink is discharged by utilizing the thermal energy. With this method, recording can be performed with higher density and higher definition.

Furthermore, this invention is effectively applicable to a recording head of a full line type having a length corresponding to the maximum width of the recording media that the recording apparatus can make recording. As such a recording head, exemplified are a structure satisfying that length by a combination of the plural recording heads, and a structure that a single recording head formed as a united body. In addition, this invention is advantageous, even of a serial type as described above, for such as a recording head secured to the apparatus body, a recording head of a replaceable chip type that allows electrical connections to the apparatus body and ink supply from the apparatus body upon mounted on the apparatus body, and a recording head of a cartridge type in which the ink tank is formed in a united body with the recording head itself.

As a feature of the inkjet recording apparatus described above, the apparatus can be, other than used as an image output terminal apparatus for information processing apparatuses such as computers, an inkjet input output apparatus capable of mounting a scanner or the like other than the recording head on the carriage, a photocopier in combination with a reader or the like, and a facsimile machine having a transmitting and receiving function. Furthermore, notwithstanding of such an apparatus for office use, this invention is applicable to other electric, electronic apparatuses including home electric products.

In the embodiments described above, the inkjet recording method is exemplified as a recording method, but this invention is not limited to this. This invention can apply even to any recording method such as thermal transfer recording methods, thermal sensing recording methods, impact recording methods such as a wire dot recording method, and other electrophotographic methods.

What is claimed is:

1. A sheet conveying apparatus comprising:

a tray for supporting a sheet;

a conveying roller for conveying the sheet in order to stack the sheet on the tray; and a projection member for contacting with a trailing end portion in the conveying direction of the sheet stacked on the tray, wherein the projection member projects upward to contact a lower surface of the sheet stacked on the tray, wherein the projection member is disposed at a position such that a leading end portion in the conveying direction of the sheet conveyed by the conveying roller does not contact the projection member as the sheet is conveyed by the conveying roller.

2. The conveying apparatus according to claim 1, wherein the projection members member has a shape such that an upstream part thereof is higher than other parts thereof to form a slant edge which slants downward toward a downstream part thereof in the conveying direction.

3. The conveying apparatus according to claim 1, wherein the projection member contacts the sheet after the sheet leaves from the conveying roller.

4. The conveying apparatus according to claim 1, wherein a leading end portion in the conveying direction of the sheet discharged from the conveying roller falls on the projection member.

5. A recording apparatus comprising:

a recording means for recording on the sheet, and said conveying apparatus according to claim 1, for conveying the sheet on which recording is made by said recording means.

* * * * *